US006483088B2

(12) United States Patent
Uehara et al.

(10) Patent No.: US 6,483,088 B2
(45) Date of Patent: Nov. 19, 2002

(54) ELECTROMAGNETIC INDUCTION HEATING DEVICE AND IMAGE RECORDING DEVICE USING THE SAME

(75) Inventors: Yasuhiro Uehara, Nakai-machi (JP); Motofumi Baba, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/962,465

(22) Filed: Sep. 26, 2001

(65) Prior Publication Data

US 2002/0043531 A1 Apr. 18, 2002

(30) Foreign Application Priority Data

Sep. 27, 2000 (JP) ..... 2000-295017

(51) Int. Cl.[7] ..... H05B 6/10; H05B 6/08; G03G 15/20

(52) U.S. Cl. ..... 219/619; 219/670; 219/672; 219/675; 399/330

(58) Field of Search ..... 219/619, 670, 219/661, 672, 662, 675; 399/328, 330, 335, 336

(56) References Cited

U.S. PATENT DOCUMENTS 4,899,025 A * 2/1990 Kamp et al. ..... 219/670
5,059,762 A * 10/1991 Simcock ..... 219/670
5,568,240 A * 10/1996 Ohtsuka ..... 219/619
6,188,054 B1 * 2/2001 Ohta ..... 219/619
6,195,525 B1 * 2/2001 Maeyama ..... 399/328
6,373,036 B2 * 4/2002 Suzuki ..... 399/330

FOREIGN PATENT DOCUMENTS

| | | |
|---|---|---|
| JP | A 8-30126 | 2/1996 |
| JP | A 8-179647 | 7/1996 |
| JP | A 9-26719 | 1/1997 |
| JP | A 9-106207 | 4/1997 |
| JP | A 10-10901 | 1/1998 |
| JP | A 10-31379 | 2/1998 |
| JP | A 11-167982 | 6/1999 |
| JP | A 11-202652 | 7/1999 |
| JP | A 2000-39796 | 2/2000 |

* cited by examiner

*Primary Examiner*—Philip H. Leung
(74) *Attorney, Agent, or Firm*—Oliff & Berridge, PLC

(57) ABSTRACT

By freely adjusting the heat generation distribution of an object to be heated, the heat generation distribution which matches a purpose can be easily obtained. In an electromagnetic induction heating device including an object to be heated having at least an electromagnetic induction heat generating layer and a magnetic field generating unit which is arranged toward the electromagnetic induction heat generating layer of the object to be heated in an opposed manner and includes an exciting coil which generates a magnetic flux penetrating the electromagnetic induction generating layer, a magnetic flux adjusting member which is made to be interlinked with a portion of the magnetic flux of the exciting coil to generate an electromagnetic induction action so that the magnetic flux acting on the electromagnetic induction heat generating layer is changed is disposed in the vicinity of the exciting coil.

20 Claims, 14 Drawing Sheets

ELECTROMAGNETIC INDUCTION HEATING DEVICE AND IMAGE RECORDING DEVICE USING THE SAME

BACKGROUND OF THE INVENTION

1. Field of the Invention

The present invention relates to an improvement of an electromagnetic induction heating device making use of an electromagnetic induction heating and an image recording device using such a heating device.

2. Related Art

Conventionally, as an image forming device such as a copying machine, a laser beam printer, a facsimile, a microfilm reader printer, an image display device or an electrostatic recording device or the like, an image forming device which forms an image by following steps has been known. That is, a sensible image (an unfixed toner image) corresponding to target image information is formed on a surface of a recording member (an electronic-fax sheet, an electrostatic recording sheet, a transfer material sheet, a printing sheet or the like) in a direct method or an indirect (transfer) method using a toner made of heat-soluble resin or the like by a suitable image forming processing unit such as an electrophotography, an electrostatic recording, a magnetic recording or the like. Then, this recording member is guided and conveyed to a heating and fixing device (an image heating device) where a heating and fixing processing is performed to form the above-mentioned image as a permanently fixed image on a surface of the recording member.

As such a heating and fixing device (image heating device), a device which adopts a heat roller system or a film heating system has been widely used.

The heat roll system includes a basic constitution which includes, for example, a metal-made heating and fixing roller incorporating a heater therein and a pressure fixing roller having resiliency which is brought into pressure contact with the heating and fixing roller. By delivering the recording member in a fixing nip area defined by a pair of these fixing rollers, a toner image is fixed by heating and pressing.

In such a heat roller system, since the heat capacity of the fixing rollers is large, it takes a considerably long time to elevate the temperature of surfaces of the fixing rollers to a fixing temperature and hence, it necessitates a long warmup. Further, to shorten time necessary for delivering the first printing, it has been necessary to prepare a standby state so as to always place the fixing rollers in a heated state.

These days, however, to overcome such a problem, efforts have been made to lower the heat capacity of the fixing roller as much as possible and now have realized a level which can eliminate the standby state.

On the other hand, as the film heating system, a device includes, in its constitution, a heater as a heating body fixedly supported, a heat-resistant film which is conveyed while being brought into pressure contact with the heater in an opposed manner and a pressure applying member which makes an object to be heated come into close contact with the heater by way of the heat-resistant film and transmits the heat of the heater to the recording member by way of the heat-resistant film.

This film heating system is a device which adopts following steps as its basic constitution. That is, the heat-resistant film is made to travel in the normal direction at the same speed as the recording member on which an image is to be fixed and which is delivered between the heat-resistant film and the pressure member. Then, by making the recording member pass through a fixing nip area formed by a pressure contact of the heat-resistant film and the pressuring member, a sensible image carrying surface of the recording member is heated by the heater by way of the heat-resistant film so as to apply heat energy to the sensible image of the recording member thus softening or fusing the sensible image. Subsequently, after passing through the fixing nip area, the heat-resistant film and the recording member are separated at a separation point.

In these heat roller system and film heating system, as the pressure/fixing roller or the pressure member, a roller body made of silicone rubber or fluororubber which exhibits excellent heat resistance and mold release characteristics has been widely used in general.

Further, as the heater, a halogen lamp or a thermal heater of the low heat capacity has been used.

The heating and fixing device adopting such a heat roller system or a film heating system has suffered from following technical problems.

That is, when a roller or a film having a large thickness and hence having high rigidity is used in consideration of the durability, the high-speed processing or the like, the heat conduction is deteriorated or the heat capacity is increased so that the thermal response is lowered whereby the state which allows the rapid heating cannot be achieved.

In other words, the roller or the film having a large thickness becomes a thermal resistance and may deteriorate the heat transfer from the heater to the recording member which constitutes the object to be heated and hence, it becomes difficult to save energy and to realize the quick starting.

To solve these technical problems, inventors of the present application have extensively studied an electromagnetic induction heating device making use of the electromagnetic induction heating which can improve the thermal efficiency by making the roller per se or the film per se generate heat thus preventing the roller or the film from becoming the heat resistance.

In such an electromagnetic induction heating device, a magnetic field generated by a magnetic field generating unit which may be formed by combining a core made of magnetic material and an exciting coil, for example, is changed by an exciting circuit (for example, a circuit which applies high-frequency wave to the exciting coil) and a roller or a film which includes an electromagnetic induction heat generating layer (conductive member "induction magnetic material, magnetic field absorption conductive material") and constitutes an object to be heated is made to pass through the generated magnetic field, and an eddy current is generated in the electromagnetic induction heat generating layer of the roller or the film due to the repetition of the generation and the extinction of the magnetic field (a fluctuation magnetic field).

In such a mode, the eddy current is transferred to heat (Joule heat) by the electric resistance of the electromagnetic induction heat generating layer and eventually only the roller or the film which is brought into close contact with the recording member which constitutes the object to be heated generates heat and hence, it becomes possible to provide a heating device capable of exhibiting the excellent thermal efficiency.

That is, when the fluctuating magnetic field traverses the inside of the conductive body (the electromagnetic induction heat generating layer in the roller or the film), the eddy current is generated in the electromagnetic induction heat generating layer of the roller or the film so as to generate a magnetic field which prevents the change of the magnetic field. Due to the skin resistance of the electromagnetic induction heat generating layer of the roller or the film, this eddy current makes the electromagnetic induction heat generating layer of the roller or the film generate heat proportional to the skin resistance.

Here, when the electromagnetic induction heat generating layer is formed close to a surface layer of the roller or the film, it becomes possible to make a portion of the roller or the film close to a surface layer directly generate heat and hence, an advantage that object to be heated can be rapidly heated irrespective of the thermal conductivity and the heat capacity of the roller or the base layer of the film.

Accordingly, it becomes possible to make the roller or the film base layer have a large thickness which ensures the high rigidity without damaging the energy saving and the quick start characteristics so that the roller or the film can satisfy the demand for high durability and the high-speed processing.

However, such an electromagnetic induction heating device still has following technical problems.

1) Since an elongated core around which an exciting coil is wound is formed by an integral molding, it is difficult to adjust a heat value in a longitudinal direction.
2) Although the exciting coil wound around the elongated core has a pattern that the exciting coils are folded at both longitudinal ends thereof, an abnormal heating phenomenon occurs at both-end folding portions of the exciting coil due to the concentration of a magnetic field. Accordingly, the temperature distribution in the longitudinal direction becomes non-uniform and there arises a possibility that the irregularity of gloss or the hot offset of a fixed image derived from a partial temperature elevation may be generated in the heating and fixing device.
3) Further, since the heat roller system exhibits a greater heat radiation quantity at end portions than the center in a fixing nip area compared with the film heating system, it becomes impossible to make a heat quantity applied to the recording member uniform and hence, there arise technical problems that the insufficient heating or the failure of fixing is brought about or toners are offset to a film at the center contrary to the film heating system.
4) Further, when sheets which constitute recording members and have a width narrower than a width of a heating area are made to pass the heating area, the heat of an area where the sheets do not pass is not consumed, and hence there also arises a technical problem that the temperature of such an area becomes higher than the temperature of the other areas.

As related arts which solve such technical problems (tasks on non-uniformity of temperature), followings are named.

The Japanese Patent Laid-open No. 30126/1996 discloses a solution in which, in an electromagnetic induction heating device, by arranging a member having a favorable heat conductivity over a heating portion in the longitudinal direction for heating an object to be heated, the temperature distribution is corrected by the dissipation of heat.

The Japanese Patent Laid-open No. 179647/1996 discloses a solution in which, by setting a winding diameter of an exciting coil arranged in the inside of a fixing roller at both longitudinal end portions thereof greater than the winding diameter of the exciting coil at a central portion thereof, the generation of heat at the both end portions of the roller is increased to provide a uniform temperature distribution.

The Japanese Patent Laid-open No. 26719/1997 discloses a solution in which, with respect to a distance between an exciting coil and an electromagnetic induction heat generating layer inside a fixing roller, by narrowing the distance at both end portions than the distance at a central portion, the absorption of a magnetic flux at both end portions is increased so that a heat value is increased whereby the sharp lowering of temperature at the end portions is corrected.

The Japanese Patent Laid-open No. 10901/1988 discloses a solution in which a core of an exciting coil is provided with the plural wiring corresponding to sizes of recording members and the generation of heat corresponding to the size of a passing recording member can be selected thus making the temperature uniform.

The Japanese Patent Laid-open No. 31379/1998 discloses a solution in which, in a low-frequency induction heating system, by making the resistance at both end portions of a fixing roller smaller than the resistance at a central portion of the fixing roller, the generation of heat at the end portions is increased so that the temperature distribution of an exciting roller can be made uniform.

The Japanese Patent Laid-open No. 106207/1997 discloses a solution in which the plural cores are arranged in the inside of a fixing roller and exciting coils are respectively wound around the cores and a parallel connection and a series connection are suitably combined as a connection structure of each exciting coil so as to make the temperature distribution of the fixing roller approximately uniform.

The Japanese Patent Laid-open No. 167982/1999 discloses a solution in which, at both end portions of an electromagnetic induction heat generating member (an object to be heated), an exciting coil is arranged in an inclined manner to an advancing direction of the exciting coil so that a heat value is increased thus making the temperature uniform.

The Japanese Patent Laid-open No. 202652/1999 discloses a solution in which a shape of a core of an exciting coil is formed in a tapered shape at both end portions of the core so that a magnetic flux absorbed at both end portions can be increased thus making the temperature distribution uniform.

The Japanese Patent Laid-open No. 39796/2000 discloses a solution in which temperature can be made uniform using the self temperature control characteristics of an object to be heated which makes use of phenomenon that the generation of heat of the object to be heated is decreased in the vicinity of a Curie point.

In this manner, although many proposals have been made in the past with respect to ideas to make the temperature distribution of the object to be heated uniform, these proposals respectively have advantages and disadvantages (examples of disadvantages: poor thermal efficiency, complicate constitution and the like) and hence, it has been practically difficult to adopt these proposals.

Further, although all of these related arts aim at making the temperature distribution of an object to be heated uniform, no consideration have been paid to an idea to freely obtain the distribution of heat generation which matches an object.

SUMMARY OF THE INVENTION

The present invention has been made in view of the above circumstances and provides an electromagnetic induction heating device which can freely adjust the heat generation distribution of an object to be heated and can easily obtain the heat generation distribution which matches a purpose and an image recording device which uses such an electromagnetic induction heating device.

According to the present invention, there is provided an electromagnetic induction heating device which has an object to be heated having at least an electromagnetic induction heat generating layer, a magnetic field generating unit which is arranged facing the electromagnetic induction heat generating layer of the object to be heated and includes an exciting coil which generates a magnetic flux penetrating the electromagnetic induction generating layer, and a magnetic flux adjusting member which is made to be interlinked with a portion of the magnetic flux of the exciting coil to generate an electromagnetic induction action so that the magnetic flux acting on the electromagnetic induction heat generating layer is changed is disposed in the vicinity of the exciting coil.

BRIEF DESCRIPTION OF THE DRAWINGS

Preferred embodiments of the present invention will be described in detail based on the following figures, wherein.

PREFERRED EMBODIMENTS OF THE PRESENT INVENTION

Figure 1:
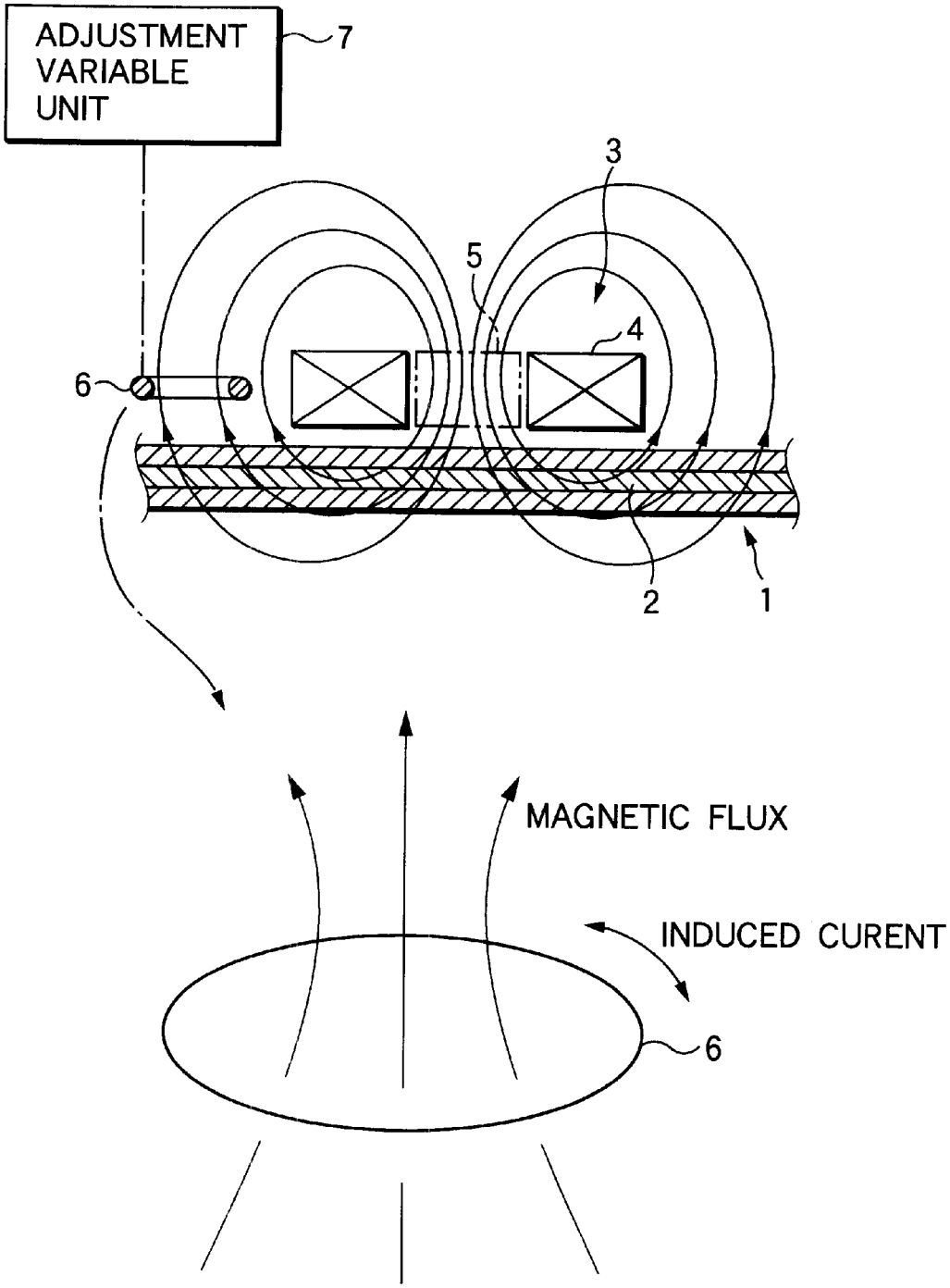
FIG. 1 is an explanatory view showing a schematic structure of an electromagnetic induction heating device according to the present invention.

According to the present invention, as shown in FIG. 1, there is provided an electromagnetic induction heating device which comprises an object 1 to be heated having at least an electromagnetic induction heat generating layer 2 and a magnetic field generating unit 3 which is arranged toward the electromagnetic induction heat generating layer 2 of the object 1 to be heated in an opposed manner and includes an exciting coil 4 which generates a magnetic flux penetrating the electromagnetic induction heat generating layer 2, wherein a magnetic flux adjusting member 6 which is made to be interlinked with a portion of the magnetic flux of the exciting coil 4 to generate an electromagnetic induction action so that the magnetic flux acting on the electromagnetic induction heat generating layer 2 is changed is disposed in the vicinity of the exciting coil 4.

In such technical units, it is sufficient for the object 1 to be heated to be provided with at least the electromagnetic induction heat generating layer 2 and the object 1 to be heated includes various members such as an image carrying transport body, a fixing member and the like.

However, since the mobile characteristics is not required as a prerequisite, the present invention is applicable to a mode in which the object 1 to be heated is fixed.

Further, as the electromagnetic induction heat generating layer 2, so long as material generates heat derived from an electromagnetic induction phenomenon using a magnetic flux, any ferro-magnetic metal such as nickel, iron, nickel-cobalt alloy, ferro-magnetic stainless steel or the like is suitably selected besides a non-magnetic conductive material such as copper, gold, silver, aluminum or the like.

Further, although the magnetic field generating unit 3 includes the exciting coil 4 as a requisite, from a view point of enhancing the generating efficiency of the magnetic fields, it is preferable to adopt a mode in which a core 5 is provided and the exciting coil 4 is wound around the core 5.

Further, the magnetic flux adjusting member 6 may be formed of any mode so long as the mode can be interlinked with a portion of the magnetic flux of the exciting coil 4 and generates the electromagnetic induction action so as to change the magnetic flux of the exciting coil 4.

Here, as a typical mode of the magnetic flux adjusting member 6, a conductive loop which is formed by winding a conductive line once or the plural times is named.

In this case, although the conductive member may be formed of a single conductive line, the conductive member may be formed of a bundle of lines which is made by binding conductive lines.

Further, the number of turns of the conductive member is not limited to a single time and may be the plural times so that the setting of the degree of electromagnetic induction action can be adjusted by the number of turns of the conductive loop.

Further, as an another typical mode of the magnetic flux adjusting member 6, a conductive member made of material having a low permeability is named. However, the conductive member applicable to the present invention is not necessarily completely non-magnetic and it is sufficient for the magnetic flux adjusting member 6 to exhibit the low permeability.

In this case, it is not always necessary for the conductive member to have a loop structure as in the case of a conductive loop and the conductive member may adopt a shape such as a simple plate or block shape or the like which allows the portion of the magnetic flux of the exciting coil 4 to be interlinked with the conductive member such that an induced current is generated around the portion.

From a view point of simplifying the constitution, as a typical mode of the magnetic field generating unit 3, a mode which holds the magnetic flux adjusting member 6 on a same holder on which the exciting coil 4 is held can be considered.

Further, with respect to a layout of the magnetic flux adjusting member 6, the position of the magnetic flux adjusting member 6 may be arbitrarily selected so long as the magnetic flux adjusting member 6 is disposed at a position where the portion of the magnetic flux of the exciting coil 4 is interlinked with the magnetic flux adjusting member 6.

For example, when the magnetic flux adjusting member 6 is disposed approximately on the same plane as the exciting coil 4, the magnetic flux adjusting member 6 may be disposed in the vicinity of the inner periphery or the outer periphery of the exciting coil 4. However, the arrangement of the magnetic flux adjusting member is not limited to such an arrangement. For example, the magnetic flux adjusting member 6 may be arranged at a position opposite to the exciting coil 4 while sandwiching the object 1 to be heated between the magnetic flux adjusting member 6 and the exciting coil 4. Alternatively, the magnetic flux adjusting member 6 may be arranged at a position opposite to the object 1 to be heated while sandwiching the exciting coil 4 between the object 1 to be heated and the magnetic flux adjusting member 6.

Further, the magnetic flux adjusting control member 6 may be mounted on a holder of the exciting coil 4 such that magnetic flux adjusting member 6 is integrally formed with the exciting coil 4.

Further, the magnetic flux adjusting member 6 may also be used for locally weakening the magnetic flux of the exciting coil 4.

Accordingly, when there locally exists a magnetic flux portion where the flux density is large in the exciting coil 4 and it is necessary to weaken this magnetic flux portion, the magnetic flux adjusting member 6 may be arranged to make the magnetic flux portion which has a greater flux density than the other neighboring portions of the flux of the exciting coil 4 acting on the electromagnetic induction heat generating layer 2 interlink the magnetic flux adjusting member 6.

Following manner of operation is achieved according to the electromagnetic induction heating device having such a constitution.

That is, as shown in FIG. 1, in accordance with the principle of electromagnetic induction, when the magnetic flux adjusting member 6 (the conductive loop being illustrated in FIG. 1) is arranged at a position where the magnetic flux adjusting member 6 can be interlinked with the magnetic flux of the exciting coil 4 of the magnetic field generating unit 3, an electromotive force proportional to the change rate of the interlinking magnetic flux is generated in the magnetic flux adjusting member 6 so that a closed circuit (an interlinking circuit) in which an induced current flows is formed in the magnetic flux adjusting member 6.

Here, the direction of the electromotive force or the direction of the current which flows upon generation of the electromotive force is a direction which the magnetic flux generated by such current impedes the change of the interlinking flux.

That is, as shown in FIG. 1, when the rate that the magnetic flux of the exciting coil 4 is interlinked with the magnetic flux adjusting member 6 is going to change, the induced current flows in the direction to produce a magnetic flux which impedes such a change and a given electromotive force is generated by this induced current.

In short, the present invention uses the principle of electromagnetic induction. That is, by providing the magnetic flux adjusting member 6 in the vicinity of the exciting coil 4 so as to generate the mutual inductance between the exciting coil 4 and the magnetic flux adjusting member 6, the magnetic flux acting on the electromagnetic inductance heat generating layer 2 from the exciting coil 4 can be controlled whereby a heat value generated in the electromagnetic induction heat generating layer 2 can be controlled.

To explain the above more specifically, as shown in FIG. 1, in an area where the flux which is interlinked with the magnetic flux adjusting member (the conductive loop in this embodiment) 6 passes, the induced current acts on the magnetic flux adjusting member 6 in the direction to impede the change of the magnetic flux of the exciting coil 4 so that the flux density from the exciting coil 4 can be reduced whereby the heat value from the electromagnetic induction heat generating layer 2 can be suppressed.

Accordingly, by selectively providing the magnetic flux adjusting member 6 in the area where the magnetic flux is strong, it becomes possible to make the magnetic flux uniform over the entire area of the heating area, for example, so that the temperature distribution can be made uniform.

Here, in the area where the magnetic flux is particularly strong, in a mode in which, for example, the conductive loop is used as the magnetic flux adjusting member 6, a method which increases the mutual inductance by increasing the number of turns of the conductive loop which constitutes an interlinking circuit is used so as to suppress the large heat generation at the portion thus achieving the uniform temperature distribution.

Further, according to the present invention, it may be possible to provide a mode in which the magnetic flux adjusting member 6 is selectively used in response to a kind of use.

In this case, the present invention may include an adjustment varying unit 7 which can vary the degree of the magnetic flux adjustment performed by the magnetic flux adjusting member 6 in addition to the above-mentioned electromagnetic induction heating device.

The manner of varying the degree of the magnetic flux adjustment which is performed by the adjustment varying unit 7 includes the varying of the degree of adjustment in multiple stages. It is needless to say that the manner of varying the degree of the magnetic flux adjustment includes a simple ON/OFF adjustment.

Further, as a typical mode of the adjustment varying unit 7, a switching element which opens/closes the conductive loop constituting the magnetic flux adjusting member 6 may be named.

On the other hand, as another mode of the adjustment varying unit 7, a mode which movably supports the magnetic flux adjusting member 6 and an interlinking area of the flux adjusting member 6 is changed relative to a portion of the magnetic flux of the exciting coil 4 is named.

Here, a mode for moving the magnetic flux adjusting member 6 may be suitably selected such that the magnetic flux adjusting member 6 is moved linearly, rotated or the like.

Subsequently, the manner of operation of the mode which adopts the adjustment varying unit 7 is explained hereinafter.

Here, in FIG. 1, for example, even when the magnetic flux distribution of the magnetic flux generated from the exciting coil 4 and the magnetic flux adjusting member 6 is uniform, when a heat quantity is locally consumed by the object 1 to be heated, the temperature of the object 1 to be heated becomes non-uniform. In such a case, by preliminarily arranging the magnetic flux adjusting member 6 at a portion of the object 1 to be heated where the heat quantity is not consumed, the magnetic flux of the area can be reduced and hence, it becomes possible to make the temperature distribution uniform.

However, there may be a case in which the portion which consumes the heat quantity is changed in the object 1 to be heated. In such a case, it is necessary to vary the degree of magnetic flux adjustment performed by the magnetic flux adjusting member 6 corresponding to respective heat value consumption patterns.

In such a circumstance, a mode which adds the adjustment varying unit 7 to the magnetic flux adjusting member 6 becomes necessary.

For example, to make both of the temperature distribution in the case in which the heat value is locally consumed at the portion of the object 1 to be heated and the temperature distribution in a case in which the heat value is consumed over the entire area of the object 1 to be heated compatible, the adjustment varying unit 7 (for example, a switching element or a moving unit) is provided to the preliminarily prepared magnetic flux adjusting member 6. Due to such a constitution, when the heat quantity is consumed over the entire area of the object 1 to be heated, the magnetic flux adjusting member 6 is made inoperable (for example, when the conductive loop is used as the magnetic flux adjusting member 6, the interlinking circuit is opened or the conductive loop is moved to a position where the conductive loop is not interlinked with the magnetic flux generated from the exciting coil 4). That is, by preventing the generation of the mutual inductance so as to prevent the generation of the induced current, it becomes possible to obtain the uniform temperature distribution in both cases.

Further, the present invention is directed not only to the electromagnetic induction heating device but also to the image recording device which uses such an electromagnetic induction heating device.

Here, as the use modes of the electromagnetic induction heating device in the image recording device, following use modes are considered.

One use mode of the electromagnetic induction heating device in the image recording device is that the image recording device is provided with an image forming unit which forms an unfixed image and a heating and fixing device which heats and fixes the unfixed image formed by the image forming unit onto a recording member, and the image recording device uses the electromagnetic induction heating device as this heating and fixing device.

Another use mode of the electromagnetic heating device in the image recording device according to the present invention, as shown in FIG. 1, includes an image carrying transport body which has an electromagnetic induction heat generating layer 2 and also works as the object 1 to be heated on which an unfixed image is carried and transported, a magnetic field generating unit 3 which is arranged toward the electromagnetic induction heat generating layer 2 of the image carrying transfer body in an opposed manner and includes an exciting coil 4 which generates a magnetic flux which penetrates the electromagnetic induction heat generating layer 2, an image forming unit not shown in the drawing which forms the unfixed image on the image carrying transport body, and a fixing device not shown in the drawing which is disposed at a position downstream of a portion of the image carrying transport body which faces the exciting coil 4 in an opposed manner and transfers and fixes an image to be fixed which is fused on the image carrying transport body onto a recording member at least by pressing the fused image to be fixed.

This image recording device is of a transfer simultaneous fixing type to which the induction heating device of the present invention is applied. Here, in the fixing device, "transfers and fixes . . . at least by pressing" means that although the transfer and fixing basically implies the pressurized transfer and the fixing performed using a press member, it does not exclude the addition of the electrostatic transfer and fixing.

In such an image recording device, since a heat quantity of the object to be heated is consumed in the area where the recording member passes, when the electromagnetic induction heating device is used, the magnetic flux adjusting member 6 (see FIG. 1) may be arranged at a portion corresponding to an area other than a passing area of the recording member, for example.

In this manner, by arranging the magnetic flux adjusting member 6 in the area where the recording member does not pass, the magnetic flux applied to the electromagnetic induction heat generating layer 2 may be reduced so that the degree of heat generation can be suppressed.

That is, the above-mentioned provision is preferable from a viewpoint that the technical problem that there is no heat dissipation from the recording member in the area where the recording member does not pass and hence, the heat generation distribution is liable to become non-uniform can be solved.

Further, in such an image recording device, to make the magnetic flux adjusting action which is performed by the magnetic flux adjusting member 6 different corresponding to the recording members having different sizes, as shown in FIG. 1, the adjustment varying unit 7 which is capable of varying the degree of the magnetic flux adjustment performed by the magnetic flux adjusting member 6 may be provided to the electromagnetic induction heating device. Due to the provision of the adjustment varying unit 7, the degree of the magnetic flux adjustment can be varied by the adjustment varying unit 7 corresponding to the recording members having different sizes so that the magnetic flux adjustment action performed by the magnetic flux adjusting member 6 can be applied to a portion corresponding to the area other than the area where the recording member passes.

The present invention is explained in detail in conjunction with attached drawings hereinafter.

(Embodiment 1)

Figure 2:
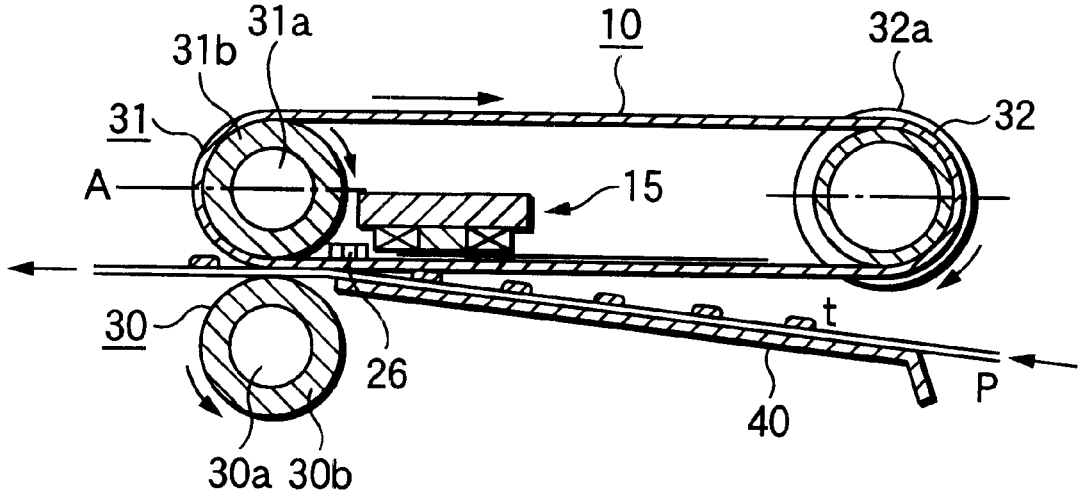
FIG. 2 is an explanatory view showing an embodiment 1 of a heating and fixing device to which the present invention is applied.

FIG. 2 is a schematic view showing an embodiment 1 directed to a heating and fixing device to which the electromagnetic induction heating device according to the present invention is applied.

As shown in the drawing, the heating and fixing device includes a fixing belt 10 which is extended between a pair of belt carrying rollers 31, 32, a pressure roller 30 which is brought into pressure contact with an opposing portion of the one belt carrying roller 31 disposed at one end of the fixing belt 10 and forms a fixing nip area together with the fixing belt 10, and a magnetic field generating device 15 which is disposed at the inside of the fixing belt 10 and performs an electromagnetic induction heating on the fixing belt 10 in the widthwise direction.

Figure 4:
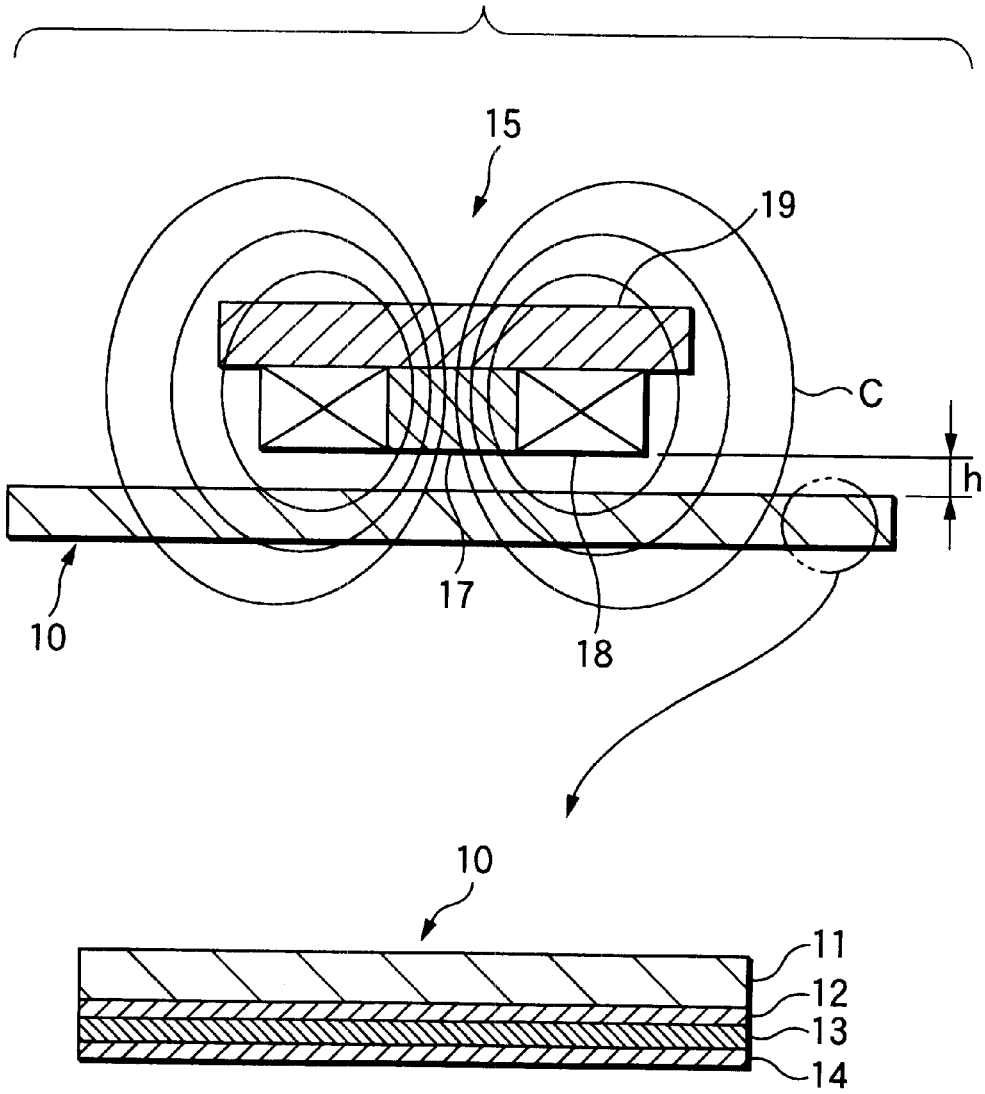
FIG. 4 is an explanatory view showing the interrelation between the magnetic field generation device and a fixing belt used in the embodiment 1.

In this embodiment, the layer constitution of the fixing belt 10 is schematically shown in FIG. 4.

As shown in the drawing, the fixing belt 10 has a composite structure made of a base layer 11 made of e.g. a polyimide layer, an electromagnetic induction heat generating layer (hereinafter called "heat generating layer" when necessary in this embodiment) 12 made of e.g. metal which is laminated on the base layer 11, a resilient layer 13 which is laminated on an outer surface of the heat generating layer 12, and a peel-off layer 14 laminated on an outer surface of the resilient layer 13 as counted from the inner peripheral side of the fixing belt 10.

For ensuring the adhesion between the base layer 11 and the heat generating layer 12, the adhesion between the heat generating layer 12 and the resilient layer 13 and the adhesion between the resilient layer 13 and the peel-off layer 14, primer layers (not shown in the drawing) may be provided between these layers.

The constitutions of the base layer 11, the heat generating layer 12, the resilient layer 13 and the peel-off layer 14 are explained in detail hereinafter.

The base layer 11 may preferably be made of heat-resistant resin such as fluororesin, polyimide resin, polyamide resin, crystalline polymer, polyamide-imide resin, PEEK resin, PES resin, PPS resin, PFA resin, PTFE resin, FEP resin or the like. The thickness of the base layer 11 may preferably be 10–1000 $\mu$m and particularly, the optimal thickness may be 25–75 $\mu$m. When the thickness of the base layer 11 is less than 10 $\mu$m, the fixing belt 10 cannot ensure the sufficient strength and also lacks in the durability. On the other hand, when the thickness of the base layer 11 exceeds 1000 $\mu$m, the fixing belt 10 cannot ensure the flexibility necessary for the belt.

The heat generating layer 12 may be made of either a ferromagnetic metal such as nickel, iron, ferromagnetic SUS or nickel-cobalt alloy or a non-magnetic metal such as copper, aluminum, gold, silver or platinum.

The thickness of the heat generating layer 12 made of magnetic metal may preferably be a value thicker than a skin depth expressed by a following equation and not more than 100 $\mu$m.

Here, the skin depth $\rho$[m] can be expressed by the following equation in view of the relationship among frequency f[Hz], permeability $\mu$ and intrinsic resistance $\rho$[$\Omega$m] of the exciting circuit.

$$\sigma=503\times(\rho/f\mu)^{1/2}$$

The thickness of heat generating layer 12 made of magnetic metal may preferably be 20–100 $\mu$m.

When the thickness of the heat generating layer 12 is smaller than 20 $\mu$m, since most of the electromagnetic energy cannot be absorbed, the shielding of the magnetic field becomes necessary. On the other hand, when the thickness of the heat generating layer 12 exceeds 100 $\mu$m, the rigidity of the fixing belt 10 becomes excessively high so that the flexibility is deteriorated whereby when the fixing belt 10 is used as a rotating body, the use of the fixing belt 10 is not practical. Accordingly, the thickness of the heat generating layer 12 is preferably 20–100 $\mu$m.

Further, when the heat generating layer 12 is made of non-magnetic metal, the skin depth becomes several hundreds $\mu$m so that when the thickness of the heat generating layer 12 is set thicker than the skin depth, the heat resistance becomes excessively small so that a sufficient generation of Joule heat cannot be obtained. In this case, with the use of thin-film metal, a heat value equal to that of the magnetic metal can be obtained. In this case, the thickness of the heat generating layer 12 may preferably be 1–20 $\mu$m inclusive. When the thickness of the heat generating layer 12 is less than 1 $\mu$m, the heat resistance becomes excessively large and hence, the sufficient generation of heat cannot be obtained.

The resilient layer 13 is preferably made of material having a favorable heat resistance and a heat conductivity such as silicone rubber, fluororubber, fluoro-silicone rubber or the like. Further, the thickness of the resilient layer 13 may preferably be 10–1000 $\mu$m inclusive. The thickness of the resilient layer 13 is a thickness necessary for assuring the quality of a fixed image.

In printing a color image, particularly, in forming a photographic image, a full image having a large area is formed on a recording member P. In such a case, when a heating surface (the peel-off layer 14) cannot trace the surface irregularity of the recording member P or the surface irregularity of the toner layer, the heating irregularity is generated and hence, the gloss irregularity is generated between portions where a heat transfer quantity is large and portions where a heat transfer quantity is small. That is, the portions having a large heat transfer quantity exhibits a high degree of gloss while the portions having a small heat transfer quantity exhibits a low degree of gloss.

With respect to the thickness of the resilient layer 13, when the thickness is less than 10 $\mu$m, the resilient layer 13 cannot trace the irregularity of the recording member P or the toner layer thus giving rise to the generation of the gloss irregularity of images. Further, when the thickness is more than 1000 $\mu$m, the heat resistance of the resilient layer 13 becomes large and hence, the quick starting becomes difficult. The thickness of the resilient layer 13 may more preferably be 30–500 $\mu$m inclusive.

When the hardness of the resilient layer 13 is excessively high, the resilient member 13 cannot trace the irregularity of the recording member P or the toner layer so that the gloss irregularity of image is generated. Accordingly, the hardness of the resilient layer 13 may preferably be not more than 60° (JIS-A), and more preferably be not more than 30° (JIS-A).

The thermal conductivity $\lambda$ of the resilient layer 13 may preferably be $6\times10^{-4}$–$2\times10^{-3}$ [cal/cm·sec·deg] inclusive.

When the thermal conductivity $\lambda$ is less than $6\times10^{-4}$ [cal/cm·sec·deg], the heat resistance is large and hence, the temperature elevation at the surface (the peel-off layer 14) of the fixing belt is delayed. On the other hand, when the thermal conductivity $\lambda$ is more than $2\times10^{-3}$ [cal/cm·sec·deg], the hardness becomes excessively high and hence, the compression permanent strain is increased.

Accordingly, the thermal conductivity $\lambda$ of the resilient layer 13 may preferably be $6\times10^{-4}$–$2\times10^{-3}$ [cal/cm·sec·deg] inclusive and may more preferably be $6\times10^{-4}$–$1.5\times10^{-3}$ [cal/cm·sec·deg] inclusive.

When the heating and fixing device is exclusively for the black-and-white fixing, there may be a case that the resilient layer 13 is eliminated due to a specific reason. In such a case, although the quick starting and the energy saving can be achieved by an amount corresponding to the decrease of the heat resistance, the quality of image after fixing is inferior to that of a case which is provided with the resilient body.

As the peel-off layer 14, material having favorable peel-off characteristics and the favorable heat resistance such as fluororesin, silicone resin, fluoro-silicone rubber, fluororubber, silicone rubber, PFA, PTFE, FEP or the like can be selected.

The thickness of the peel-off layer 14 is preferably 1–30 $\mu$m inclusive. When the thickness of the peel-off layer 14 is less than 1 $\mu$m, it brings about problems that portions where the peel-off characteristics are deteriorated are formed due to the coating irregularity of a coated film or the sufficient durability is not achieved. On the other hand, when the thickness of the peel-off layer 14 exceeds 30 μm, it brings about a problem that the thermal conduction is deteriorated. When the thickness of the peel-off layer 14 exceeds 30 μm, it brings about a problem that the thermal conductivity of the layer becomes deteriorated, and particularly, with respect to the resin-based peel-off layer 14, the hardness becomes excessively high so that the intrinsic advantageous effect of the resilient layer 13 is lost.

Further, one belt carrying roller 31 of the fixing belt 10 may be used as a drive roller, for example, wherein the belt carrying roller has a core 31*a* and a heat-resistant resilient layer 31*b* made of silicone rubber, fluororubber, fluororesin or the like which is formed by an integral molding such that the layer 31*b* concentrically covers the core 31*a*. The core 31*a* has both end portions thereof rotatably supported and held by bearings between chassis-side metal plates of the device not shown in the drawing. Here, the drive roller 31 is rotatably driven in the clockwise direction indicated by an arrow by a drive mechanism not shown in the drawing.

On the other hand, the other belt carrying roller 32 of the fixing belt 10 is used as a tension roller and this tension roller 32 applies a tension to the fixing belt 10 so as to make the fixing belt 10 rotated in a stable manner.

Flange members 32*a* which restrict and hold end portions of the fixing belt 10 are fixedly mounted on both ends of the tension roller 32. These flange members 32*a* receive the end portions of the fixing belt 10 when the fixing belt 10 is rotated so as to play a role of restricting the wobbling movement of the fixing belt in the widthwise direction.

Further, the pressure roller 30 has a core 30*a* and a heat-resistant resilient layer 30*b* made of silicone rubber, fluororubber, fluororesin or the like which is formed by an integral molding such that the layer 30*b* concentrically covers the core 30*a*. The core 30*a* has both end portions thereof rotatably supported and held by bearings between chassis-side metal plates of the device not shown in the drawing.

Further, a push-up force is applied to the pressure roller 30 by a push-up mechanism not shown in the drawing. Due to such a constitution, the drive roller 31 and the upper surface of the pressure roller 30 are brought into pressure contact while sandwiching the fixing belt 10 between them thus forming a fixing nip area of a given width.

Due to a frictional force generated between the drive roller 31 and an inner surface of the fixing belt 10 when the drive roller 31 is rotatably driven, a rotational force acts on the fixing belt 10 so that the fixing belt 10 is rotated in the clockwise direction indicated by an arrow at a peripheral speed approximately corresponding to the rotational peripheral speed of the drive roller 31.

Figure 3:
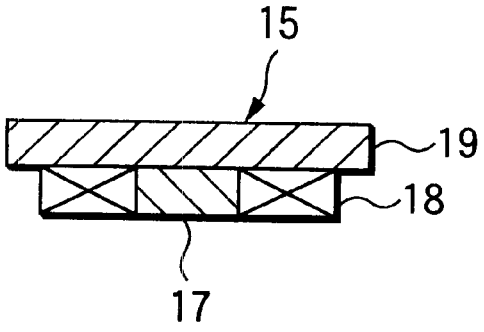
FIG. 3 is an explanatory view showing a schematic structure of a magnetic field generating device used in the embodiment 1.

Further, as shown in FIG. 2 to FIG. 4, the magnetic field generating device 15 includes an elongated insulating holder 19 extending in the widthwise direction of the fixing belt 10. A magnetic core 17 is arranged on the holder 19 and an exciting coil 18 is wound around the periphery of the magnetic core 17 such that the exciting coil 18 is held by the magnetic core 17.

Here, although it is desirable that the distance between the magnetic field generating device 15 and the heat generating layer 12 is made as small as possible, the minimum value should be designed within a limitation imposed on designing.

In this embodiment, the fixing belt 10 and the magnetic field generating device 15 are arranged in a non-contact state. This arrangement is provided for preventing the lowering of the temperature of the fixing belt 10 derived from the contact of the magnetic field generating device 15 having a large heat capacity with the fixing belt 10. In an illustrated example, the distance between the fixing belt 10 and the magnetic field generating device 15 is set to h (for example, approximately 1 mm) by a positioning mechanism not shown in the drawing.

In this embodiment, the holder 19 may preferably be made of material having the favorable insulation and the favorable heat resistance. It is preferable to select, for example, phenol resin, fluororesin, polyimide resin, polyamide resin, polyamide-imide resin, PEEK resin, PES resin, PPS resin, PFA resin, PTFE resin, FEP resin, LCP resin or the like as the material of the holder 19.

Further, the magnetic core 17 is made of material having high permeability. Such material may preferably be material such as ferrite or permalloy used for a core of a transformer, and more preferably be ferrite which exhibits the least loss even when the frequency is not less than 100 kHz.

Further, with respect to the exciting coil 18, as conductive lines (electric lines) which constitute the coil (wire ring), a conductive line which is formed by bundling the plural thin copper wires each of which is provided with an insulation coating may be used, wherein the conductive line is wound the plural times (for example, 12 turns).

The insulation coating may preferably be a coating having heat resistance in view of the heat conduction derived from the heat generation of the fixing belt 10. In this embodiment, assuming that the coating is made of polyimide resin, for example, the heat-resistant temperature is 260° C. Here, the concentration may be enhanced by applying pressure to the exciting coil 18 from outside of the exciting coil 18.

Further, an electricity feed portion of the exciting coil 18 is connected to an exciting circuit (not shown in the drawing). This exciting circuit is capable of generating high frequency wave of 20 kHz to 100 kHz with a switching power source. As a result, the exciting coil 18 can generate an alternating magnetic flux using an alternating current (high frequency current) fed from the exciting circuit.

Figure 5:
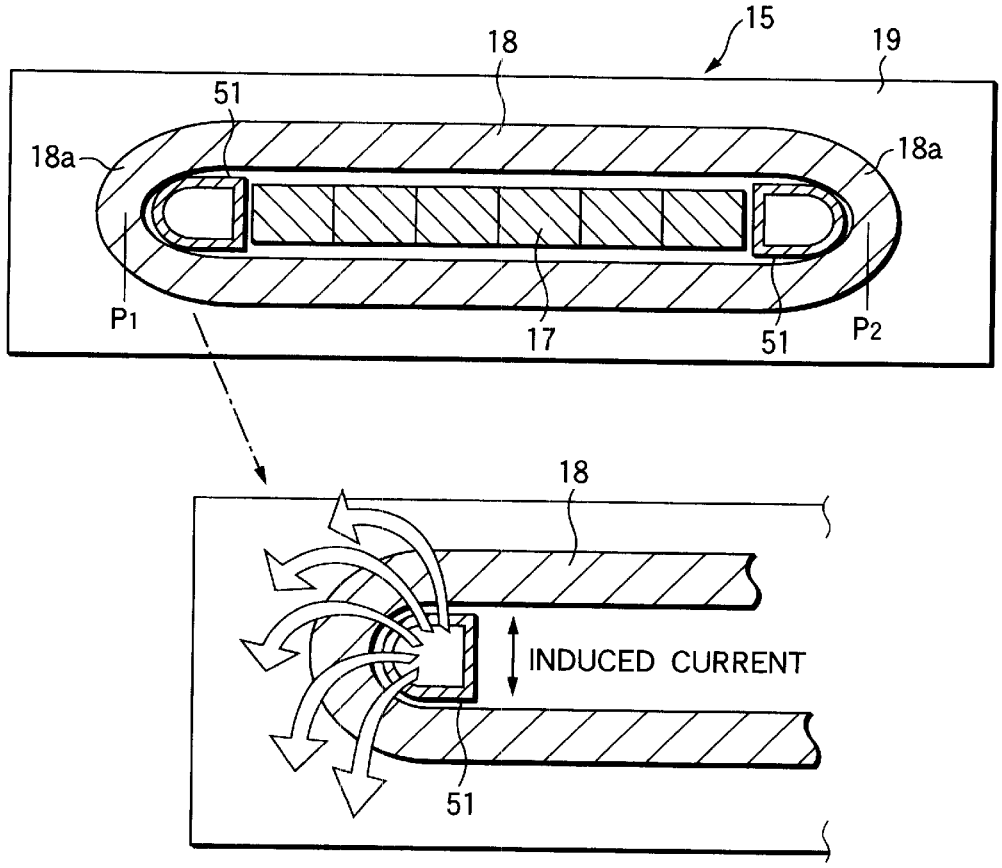
FIG. 5 is a planner explanatory view showing the detail of the magnetic generating device used in the embodiment 1.

Particularly, as the magnetic field generating device 15 according to this embodiment, as shown in FIG. 5, in the inside of fold-back portions 18*a* disposed at both ends of the exciting coil 18, conductive loops 51 which are made of loop-shaped conductive material are arranged at positions where the conductive loops 51 are interlinked with the magnetic flux of the exciting coil 18.

In this embodiment, although the conductive loops 51 are fixedly arranged on the holder 19, for example, the coil holding structure is not limited to such a structure.

Further, when these conductive loops 51 are interlinked with the magnetic flux of the exciting coil 18, a large induced current is generated in the conductive loops 51.

Here, when the electric resistance of the conductive loops 51 is large, Joule heat is generated in the inside of the conductive loops 51. Since this thermal energy is not used for the heat generation of the heat generating layer 12 of the fixing belt 10, the energy brings about the energy loss. To prevent this energy loss, it is desirable that the resistance of the conductive loops 51 is as small as possible.

Particularly, considering the skin effect of the high-frequency current, in this embodiment, it is preferable to use the conductive loops 51 having a constitution approximately equal to that of the wire bundle used in the exciting coil 18. That is, as conductive lines (electric lines) which constitutes the coil (the wire ring), a conductive line which is formed by bundling the plural thin copper wires each of which is provided with an insulation coating may be used, wherein the conductive line is wound the plural times. In this case, since the generated Joule heat in the conductive loops 51 is not more than several watt, this does not bring about the lowering of the efficiency.

In FIG. 2, numeral 26 indicates a temperature sensor which detects the temperature of the fixing belt 10 and supplies detected temperature information to a temperature control device not shown in the drawing, and numeral 40 indicates a guide which guides and transports the recording member P.

Subsequently, the manner of operation of the heating and fixing device according to the present invention is explained hereinafter.

As shown in FIG. 2 to FIG. 5, to operate the heating and fixing device, the drive roller (the belt carrying roller) 31 is rotatably driven and simultaneously an alternating current is supplied to the exciting coil 18 from the exciting circuit not shown in the drawing to generate an alternating magnetic flux generated from the exciting coil 18 as shown in FIG. 4.

Here, the alternating magnetic flux C led to the magnetic core 17 generates an eddy current in the heat generating layer 12 of the fixing belt 10. This eddy current generates Joule heat (eddy current loss) in the heat generating layer 12 due to the intrinsic resistance of the heating generating layer 12. The heat value Q generated in the heat generating layer 12 is determined by the density of the flux which penetrates the heat generating layer 12.

Then, the heat generated in the heat generating layer 12 is used for heating the fixing belt 10 by way of the resilient layer 13 and the peel-off layer 14.

In this embodiment, the temperature control device not shown in the drawing controls the current supply to the exciting coil 18 based on temperature information of the fixing belt 10 detected by the temperature sensor 26 so that the temperature control of the fixing belt 10 can be performed so as to maintain the temperature of the fixing nip area at a given temperature.

On the other hand, the fixing belt 10 is rotated upon rotational driving of the drive roller 31 and the fixing belt 10 which is heated by the electromagnetic induction heating is advanced to the fixing nip area and the temperature of the fixing belt 10 is adjusted to a given temperature in the fixing nip area.

In this state, the recording member P which is transported from the image forming portion not shown in the drawing and on which the unfixed toner image t is formed is delivered to the fixing nip area formed between the fixing belt 10 and the pressure roller 30 in a state that the image-formed surface is directed upwardly, that is, the image-formed surface faces the surface of the fixing belt 10 in an opposed manner. In the fixing nip area, the image-formed surface is brought into close contact with the outer surface of the fixing belt 10 and the recording member P is transported in a nipped state together with the fixing belt 10 in the fixing nip area.

In the course of process of transporting the recording member P in a nipped state together with the fixing belt 10 in the fixing nip area, the unfixed toner image t on the recording member P is heated by the heat generated by the electromagnetic induction in the fixing belt 10 and is fixed onto the recording member P by heating.

When the recording member P passes the fixing nip area, the recording member P is separated and discharged and transported from the outer surface of the fixing belt 10. Then, after passing the fixing nip area, the heated fixed toner image t on the recording member P is cooled and becomes a permanent fixed image.

In this embodiment, although it is unnecessary to provide an oil coating mechanism to the heating and fixing device for preventing an offset when a toner containing a low softening substance is used as the toner, it is preferable to provide the oil coating mechanism to the heating and fixing device when a toner containing no low softening substance is used as the toner. Further, it is needless to say that even when the toner containing a low softening substance is used, the oil coating and the separation by cooling can be performed.

On the other hand, to obtain the uniform temperature distribution in the fixing nip area, it is necessary to apply a uniform magnetic distribution to the heat generating layer 12 of the fixing belt 10 along the widthwise direction of the fixing belt 10 in the magnetic field generating device 15.

Figure 6:
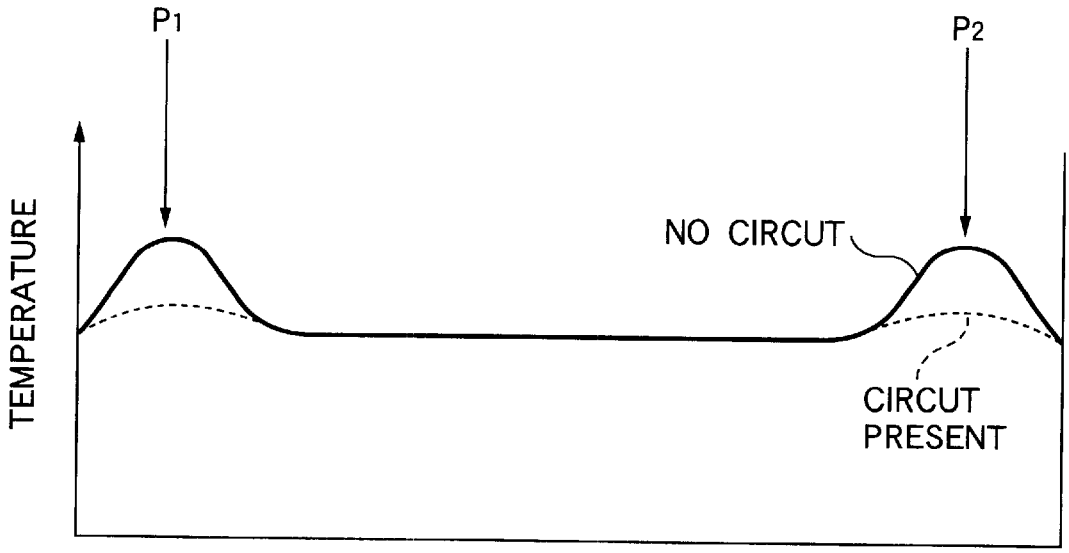
FIG. 6 is a graph showing the fixing performance of the heating and fixing device according to the embodiment 1.

FIG. 6 is a schematic view showing the heat generation distribution of the fixing belt 10 produced by the magnetic field generating device 15.

In the drawing, P1, P2 indicate positions of the fold-back portions disposed at both ends of the exciting coil 18 of the magnetic field generating device 15 (see FIG. 5).

In the drawing, a solid line indicates the temperature distribution when the interlinking circuit made of the conductive loops 51 is not present (abbreviated as "circuit" in the drawing), wherein temperature elevating phenomenon which occurs at portions of the fixing belt 10 corresponding to both end portions of the exciting coil 18 is derived from the fact that the magnetic flux is locally concentrated on the fold-back portions at the longitudinal end portions of the exciting coil 18.

To solve such a problem, it becomes necessary to reduce a heat value at the both widthwise end portions of the heat generating layer 12 of the fixing belt 10. According to this embodiment, as mentioned above, the conductive loops 51 are respectively arranged at positions which are disposed at the inside of the fold-back portions of the both end portions of the exciting coil 18 and are interlinked with the magnetic flux of the exciting coil 18 (see FIG. 5).

These conductive loops 51 generate an electromotive force proportional to the rate of change of magnetic flux of the exciting coil 18 as time lapses so that the induced current flows. The flow direction of the induced current is a direction which a magnetic flux which is generated by the induced current impedes the change of the interlinking magnetic flux.

Due to such a provision, the magnetic flux of the exciting coil 18 which is interlinked with the heat generating layer 12 in the vicinity of both widthwise ends of the fixing belt 10 is weakened so that the temperature elevating phenomenon is reduced.

Here, by increasing the number of turns of the conductive loops 51, the magnetic flux of the exciting coil 18 which is interlinked with the heat generating layer 12 can be further reduced and hence, by selecting the optimal number of turns, it becomes possible to make the temperature distribution in the widthwise direction of the fixing belt 10 uniform.

Accordingly, in a mode where the interlinking circuit made of the conductive loops 51 is present, as indicated by a dashed line in FIG. 6, the temperature distribution in the widthwise direction of the fixing belt 10 can be maintained uniform.

In this embodiment, the change of inductance generated by providing the conductive loops 51 whose number of turns is set to 3 was measured. The result shows that the inductance was reduced from $50\mu$ henry to $42\mu$ henry and it was confirmed that the a heat value at both end portions of the fixing belt 10 was reduced by a quantity corresponding to the change of impedance.

That is, in the magnetic field generating device 15 of this embodiment, by generating the mutual inductance between the exciting coil 18 and the conductive loops 51, the magnetic flux applied to the heat generating layer 12 of the fixing belt 10 can be controlled whereby the heat value generated by the heat generating layer 12 can be controlled.

Figure 7:
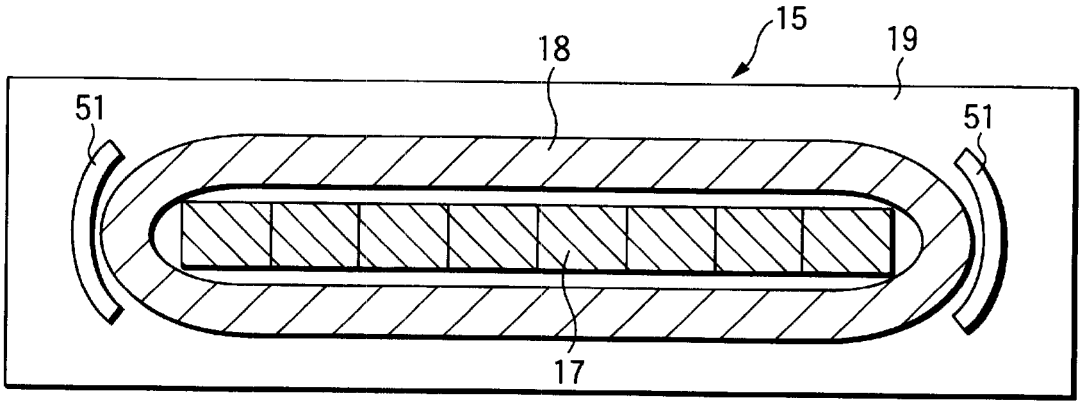
FIG. 7 is an explanatory view showing a modification of the heating and fixing device according to the embodiment 1.

Further, although the conductive loops 51 are arranged in the inside of the fold-back portions 18*a* of the exciting coil 18 in this embodiment, the arranging positions of these conductive loops 51 are not limited to such positions and the conductive loops 51 may be arranged at the outside of the exciting coil 18 as shown in FIG. 7.

Further, it is not always necessary to arrange the conductive loops 51 on the holder 19 and hence, it is unnecessary to arrange the conductive loops 51 on the same surface on which the exciting coil 18 is arranged. That is, so long as the conductive loops 51 can be interlinked with portions of the magnetic flux generated from the exciting coil 18, the conductive loops 51 can be arranged at any positions.

Figure 8A:
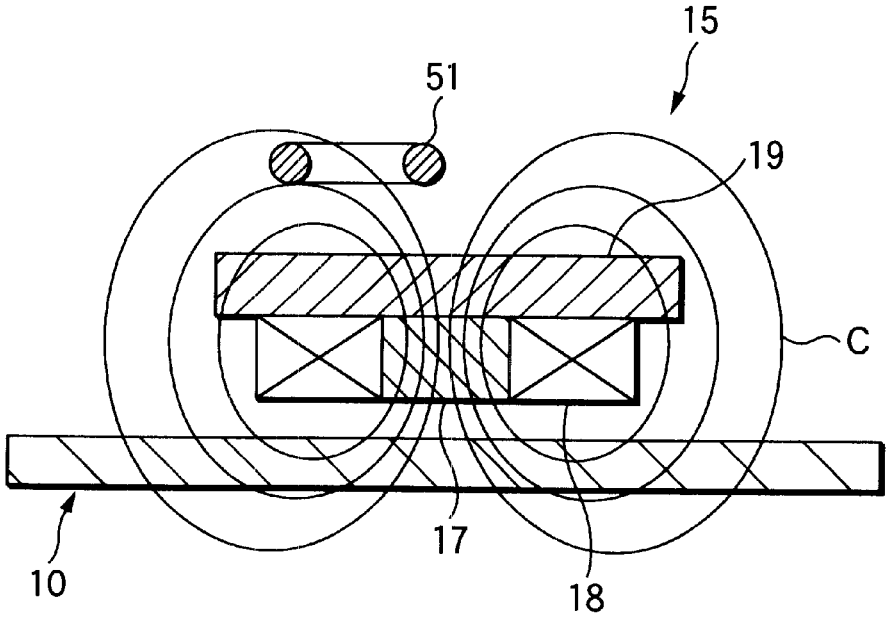
FIG. 8A and FIG. 8B are explanatory views showing other modifications of the heating and fixing device according to the embodiment 1.
Figure 8B:
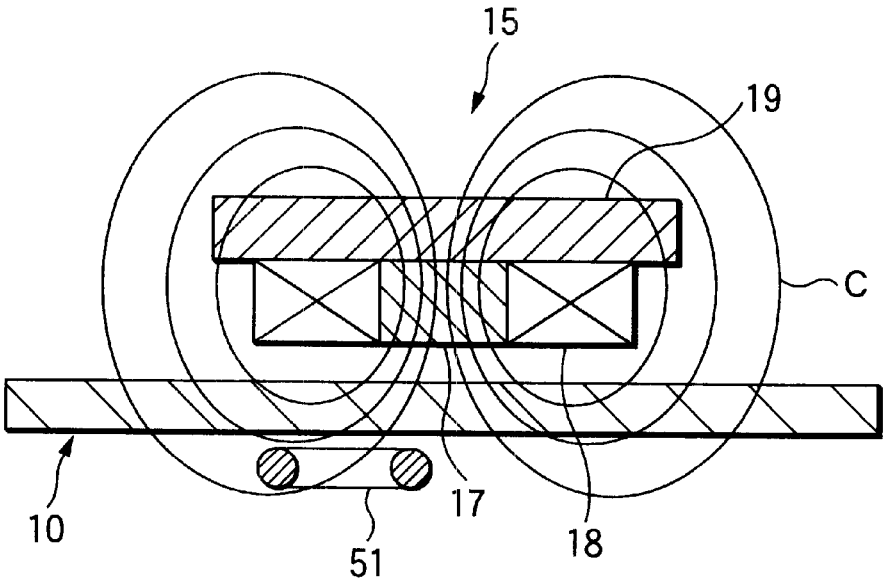

For example, when the conductive loops 51 cannot be arranged on the same plane on which the exciting coil 18 is arranged as shown in FIG. 8A, the conductive loop 51 may be arranged at a position opposite to the heat generating layer 12 of the fixing belt 10 while sandwiching the exciting coil 18 therebetween. Alternately, when the heat generating layer 12 of the fixing belt 10 is made of non-magnetic material and hence, the heat generating layer 12 allows most of the magnetic flux of the exciting coil 18 to penetrate the heat generating layer 12, as shown in FIG. 8B, the conductive loop 51 may be arranged at a position opposite to the exciting coil 18 while sandwiching the heat generating layer 12 of the fixing belt 10 therebetween.

Figure 9:
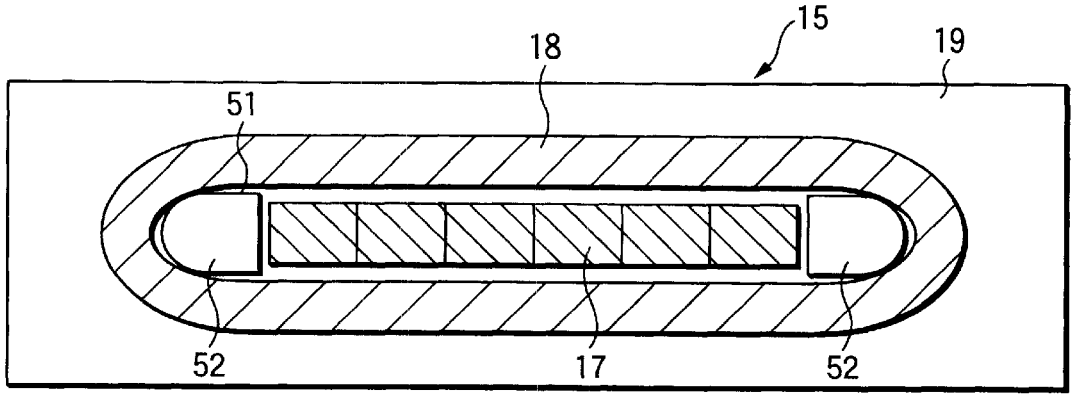
FIG. 9 is an explanatory view showing a further modification of the heating and fixing device according to the embodiment 1.

Further, although the conductive loops 51 are used as the magnetic flux adjusting members in this embodiment, the present invention is not limited to this mode. In place of the conductive loops 51, as shown in FIG. 9, conductive plates 52 having a shape approximately equal to the contour of the conductive loops 51 may be arranged at the same positions as the conductive loops 51. Here, the conductive plates 52 may preferably be made of metal material, for example. As the metal material, metal such as copper, aluminum, gold, silver, platinum or the like which exhibits the least intrinsic resistance value and the low permeability is optimal.

In such a mode, when portions of the magnetic flux generated from the exciting coil 18 are interlinked with the conductive plates 52, the induced current flows around the conductive plates 52 in a loop shape thus forming an interlinking circuit corresponding to the conductive loops 51 which act to adjust the magnetic flux generated from the exciting coil 18.

In this embodiment, as the conductive plates 52, copper plates having a thickness of 2 mm and having a contour equal to that of the previously-mentioned conductive loop 51 were arranged at the same positions as the conductive loops 51 and then a change quantity of the inductance was measured. The result shows that the inductance was reduced from 50$\mu$ henry to 47$\mu$ henry in this embodiment and it was confirmed that the a heat value at both end portions of the fixing belt 10 was reduced by a quantity corresponding to the change of impedance.

Further, although a mode in which the heating and fixing device adopts the fixing belt 10 as an object to be heated in this embodiment, it is needless to say that the present invention is applicable to a mode in which the heating and fixing device adopts a fixing roller per se as an object to be heated. In this case, the heating and fixing device may be constituted such that a magnetic field generating device is arranged in the vicinity of an inside or an outside of the fixing roller and the fixing roller per se functions as an electromagnetic induction heat generating layer.

In case the fixing roller becomes the object to be heated, since the fixing roller is required to ensure a sufficient strength as a structural body, the wall thickness thereof should be not less than 100 $\mu$m.

Further, when the structural body per se is made of electromagnetic induction material (material constituting an electromagnetic induction heat generating layer), to ensure the sufficient Joule heat generation with such a thickness, the material must be ferromagnetic metal. As such material, nickel, iron, ferromagnetic SUS, nickel-cobalt alloy or the like can be named.

On the other hand, when the structural body is not made of the electromagnetic induction material, for example, when the structural body is made of ceramic or the heat-resistant resin which has been previously mentioned as the material of the base layer 11 of the fixing belt 10, the constitution of the structural body differs from the constitution of the fixing belt only with respect to the thickness of the base layer 11 and is equal to the constitution of the fixing belt with respect to other constituent parts such as the heat generating layer 13, the resilient layer 13 and the peel-off layer 14.

(Embodiment 2)

Figure 10:
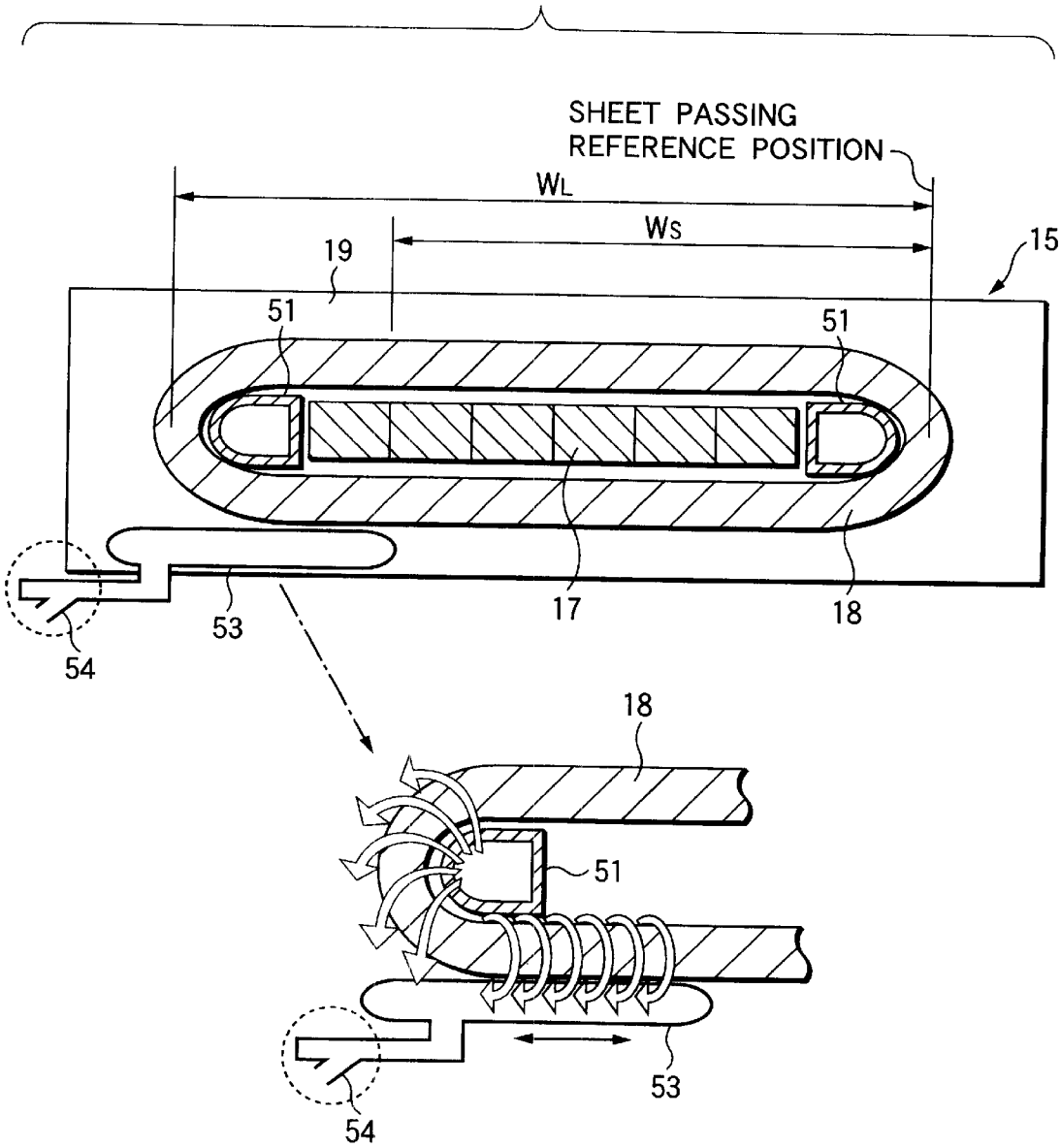
FIG. 10 is an explanatory view showing the detail of a magnetic field generating device of a heating and fixing device according to an embodiment 2.

FIG. 10 is an explanatory view showing an essential part (magnetic field generating device) of a heating and fixing device to which the present invention is applied.

In the drawing, the magnetic generating device 15, as in the case of the embodiment 1, includes an elongated insulating holder 19 which is extended in the widthwise direction of a fixing belt 10 (see FIG. 2). A magnetic core 17 is arranged on this holder 19 and an exciting coil 18 is wound around and held around the periphery of the magnetic core 17. Further, conductive loops 51 (or conductive plates 52) are arranged in the vicinity of inside of fold-back portions 18a disposed at both ends of the exciting coil 18. Such a constitution is provided for acquiring the uniform heat generation distribution over the entire area in the widthwise direction of the fixing belt 10.

However, even when the fixing belt 10 exhibits the uniform heat generation distribution over the fixing belt 10 in the entire widthwise direction, when small-sized sheets, that is, recording members (sheets) having a passing sheet width smaller than the width of the heat generating area continuously pass the fixing nip area, the heat held by the area of the fixing belt 10 where the sheets do not pass is not consumed so that a phenomenon that the temperature of such an area becomes high compared with the temperature of the area on which the sheets pass occurs and hence, there exists the possibility that the heat generation distribution of the fixing belt 10 becomes non-uniform.

The magnetic field generating device 15 according to this embodiment is provided for preventing such a phenomenon. That is, to suppress the heat generation in the area where the sheets do not pass, in addition to the conductive loop 51, another conduction loop 53 is arranged at a position where the conduction loop 53 is interlinked with a magnetic flux portion which corresponds to the area where the sheets do not pass among the magnetic flux generated from the exciting coil 18 (one-side position of the longitudinal fold-back portions 18*a* of the exciting coil 18 in this embodiment). Further, this conductive loop 53 is opened or closed by way of a switch 54.

In FIG. 10, a symbol X indicates a passing sheet reference position which indicates a side edge reference position when the sheets which constitutes the recording members pass, a symbol WL indicates a width dimension of large-sized sheets (full-size sheets in this embodiment) and a symbol WS indicates a width dimension of small-sized sheets.

In this embodiment, it is designed that under the condition that the small-sized sheets pass, the switch 54 of the conductive loop 53 is closed.

Figure 11:
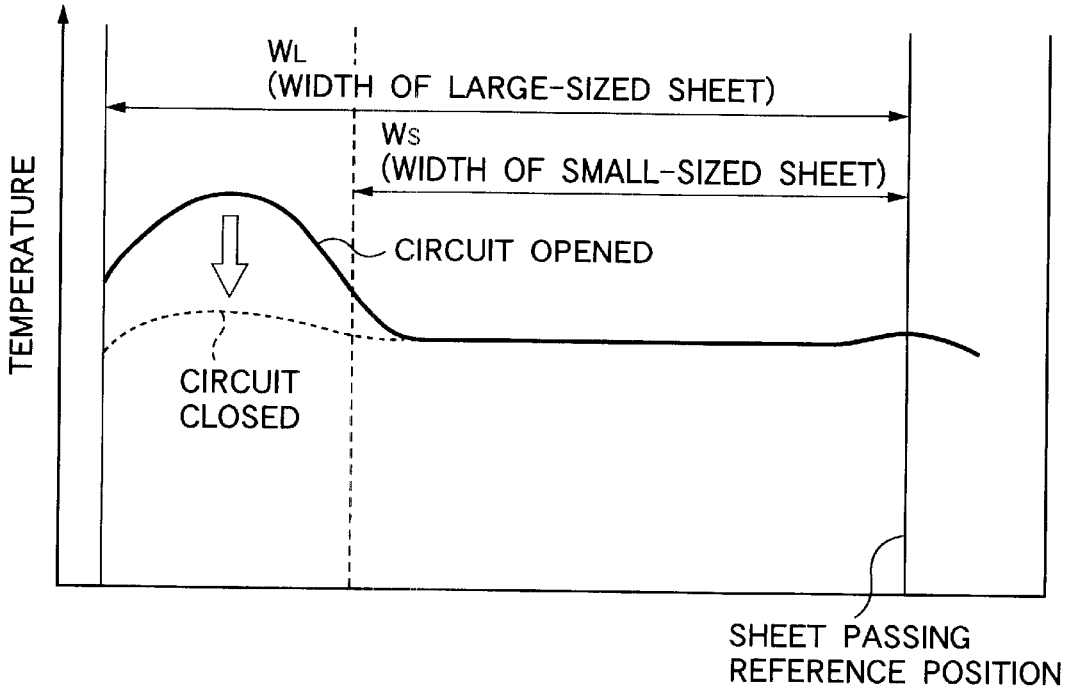
FIG. 11 is a graph showing the fixing performance of the heating and fixing device according to the embodiment 2.

In this case, the magnetic flux portion corresponding to the area where the sheets do not pass among the magnetic flux generated from the exciting coil 18 is interlinked with the closed conductive loop 53 and hence, an interlinking circuit in which an induced current flows is formed in the conductive loop 53. Along with the formation of the interlinking circuit, a magnetic flux is generated in a direction to impede the magnetic flux of the exciting coil 18 so that the magnetic flux generated from the exciting coil 18 is decreased and the heat generation is suppressed as indicated by a dashed line in FIG. 11 at a portion of the fixing belt 10 corresponding to the area where the sheets do not pass by a quantity corresponding to the decrease of the magnetic flux of the exciting coil 18.

Accordingly, even when the small-sized sheets pass, the state that the temperature of the area of the fixing belt 10 where the sheets do not pass is elevated excessively can be effectively obviated.

On the other hand, it is designed that under the condition that large-sized sheets (full-size sheets) pass, the switch 54 of the conductive loop 53 is opened.

In this case, although the magnetic flux portion corresponding to the area where the sheets do not pass among the magnetic flux generated from the exciting coil 18 is interlinked with the conductive loop 53 portion, since the conductive loop 53 is opened, the interlinking circuit in which the induced current flows is not formed in this conductive loop 53. Accordingly, a magnetic flux which impedes the magnetic flux generated from the exciting coil 18 is not generated from the conductive cable 53 and hence, the magnetic flux of the exciting coil 18 is not impeded.

Accordingly, when the large-sized sheets pass, the conductive loop 53 becomes completely inoperable and hence, the uniform heating can be ensured over the entire area of the fixing belt 10 in the widthwise direction.

In this manner, by performing the open/close manipulation of the switch 54 of the conductive loop 53, the uniform temperature distribution can be easily achieved with respect to both of the large-sized sheets and the small-sized sheets.

In this embodiment, the conductive loop 53 whose number of turns is 4 was arranged corresponding to the area where the sheets do not pass and the change quantity of the inductance when the switch 54 was closed was measured. The result shows that the inductance was reduced from 50$\mu$ henry to 40$\mu$ henry and hence, a heat value of the area of the fixing belt 10 where the sheets do not pass could be suppressed by a quantity corresponding to the decrease of the inductance. Accordingly, it was confirmed that the uniform temperature distribution can be obtained by this embodiment.

Further, the inductance at the time of opening the switch 54 of the conductive loop 53 remained the same value, that is, 50 $\mu$m henry.

Figure 12:
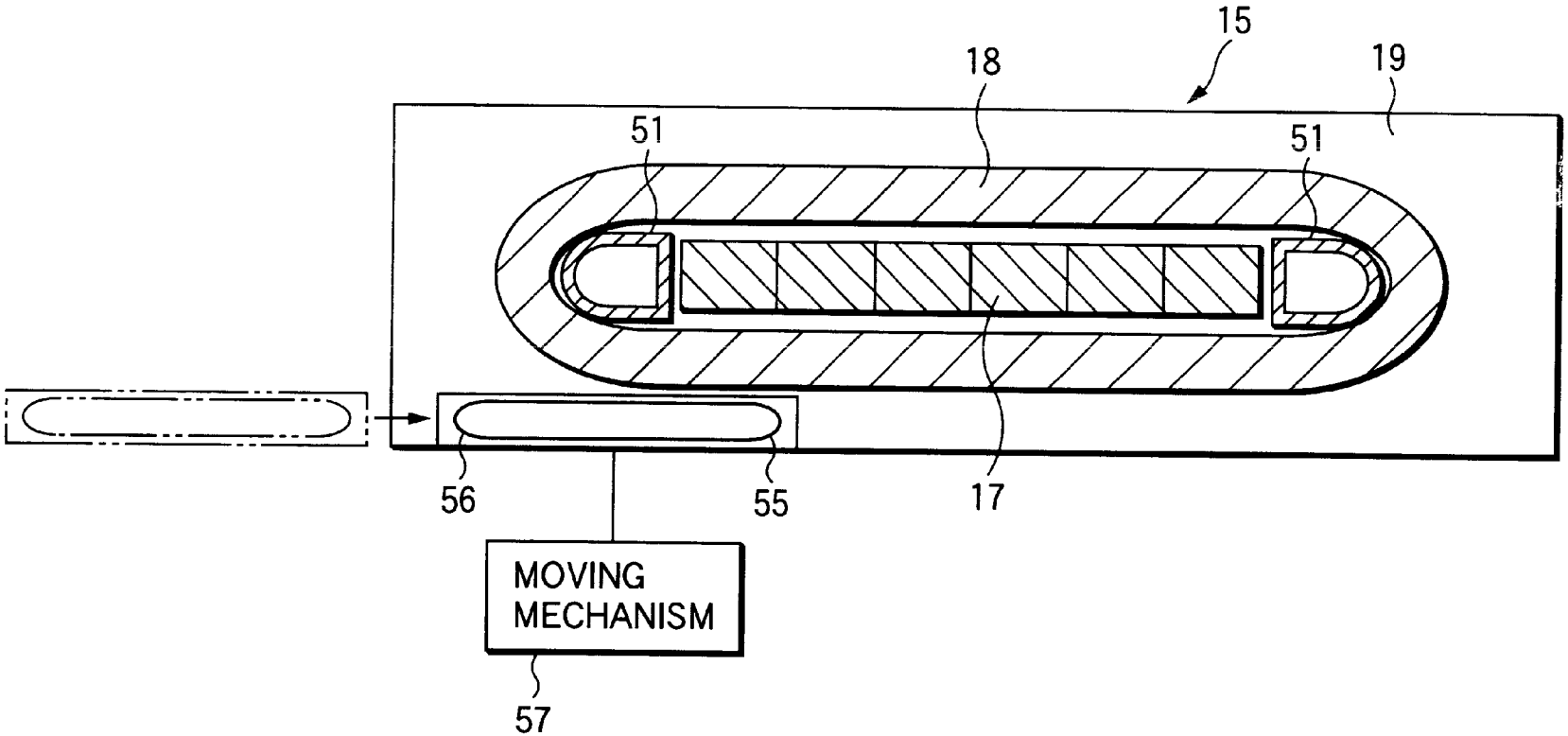
FIG. 12 is an explanatory view showing a modification of the heating and fixing device according to the embodiment 2.

Further, although a mode in which the open/close switch 54 is provided to a portion of the conductive loop 53 in this embodiment, the embodiment is not limited to such a mode. For example, as shown in FIG. 12, a conductive loop 55 may be arranged on a movable base 56 separately from the holder 19 and the conductive loop 55 may be provided such that the conductive loop 55 is capable of moving along the longitudinal direction of the exciting coil 18, for example, by moving the movable base 56 by means of a moving mechanism 57. The moving direction of the conductive loop 55 is not limited to the longitudinal direction of the exciting coil 18 and may be set to any arbitrary direction including the widthwise direction of the exciting coil 18 as a typical example.

In this embodiment, for example, under the condition that the small-sized sheets pass, the conductive loop 55 may be moved to and arranged at a position indicated by a solid line in FIG. 12 (a position corresponding to the area where the sheets do not pass) so as to prevent the temperature of the area of the fixing belt 10 where the sheets do not pass from being excessively elevated.

On the other hand, under the condition that the large-sized sheets pass, the conductive loop 55 may be moved to and arranged at a position indicated by a chained line in FIG. 12 (a position where the magnetic flux of the exciting coil 18 is not interlinked). In this case, there is no possibility that the magnetic flux of the exciting coil 18 is interlinked with the conductive loop 55 and hence, the magnetic flux adjustment by the conductive loop 55 is not applied to the magnetic flux of the exciting coil 18 whereby the fixing belt 10 is uniformly heated over the entire area of the fixing belt 10 in the widthwise direction.

Figure 13:
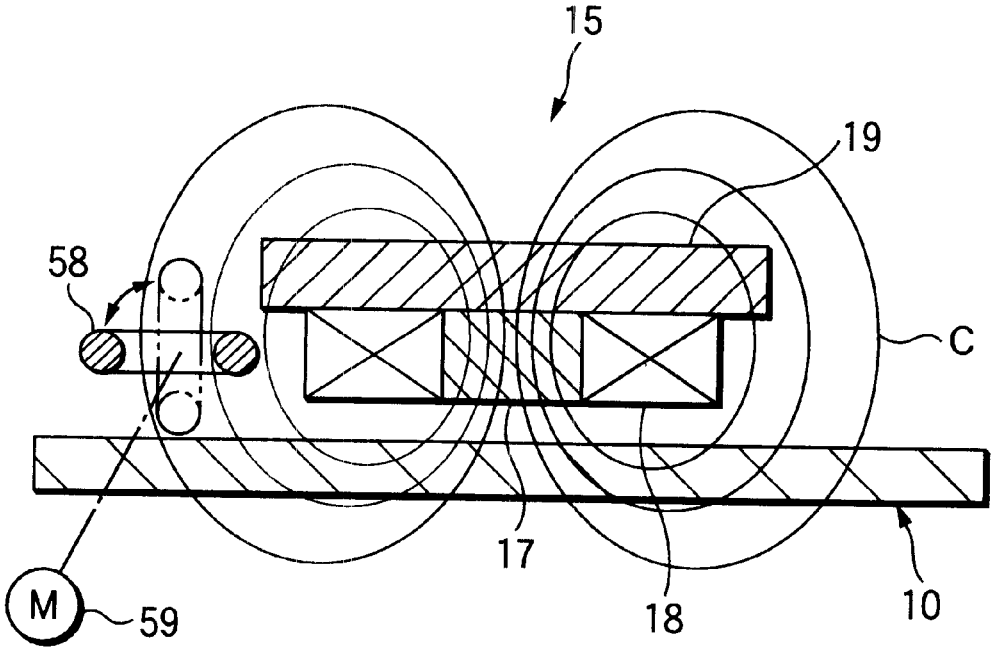
FIG. 13 is an explanatory view showing another modification of the heating and fixing device according to the embodiment 2.

Further, as another modification, as shown in FIG. 13, for example, a closed conductive loop 58 is rotatably arranged at a position where the conductive loop 58 is interlinked with a magnetic flux portion corresponding to the area where the sheets do not pass among the magnetic flux of the exciting coil 18, and the conductive loop 58 may be rotatably moved by a drive unit 59 such as a stepping motor between a position where the conductive loop 58 is interlinked with the magnetic flux generated from the exciting coil 18 (indicated by a solid line in the drawing) and a position where the conductive loop 58 is arranged in parallel to the magnetic flux so that the conductive loop 58 is not interlinked with the magnetic flux (indicated by a chained line in the drawing).

According to such a mode, when the small-sized sheets pass, as indicated by the solid line in FIG. 13, the conductive loop 58 may be rotatably moved such that a portion of the magnetic flux generated from the exciting coil 18 is interlinked with the conductive loop 58. In this case, it becomes possible to prevent the temperature of the area of the fixing belt 10 where the sheets do not pass from being excessively elevated.

On the other hand, under the condition that the large-sized sheets pass, the conductive loop 58 may be rotatably moved as indicated by the chained line in FIG. 13. In this case, there is no possibility that the magnetic flux of the exciting coil 18 is interlinked with the conductive loop 58 and hence, the magnetic flux adjustment by the conductive loop 58 is not applied to the magnetic flux of the exciting coil 18 whereby the fixing belt 10 is uniformly heated over the entire area of the fixing belt 10 in the widthwise direction.

Further, in all of this embodiment and the modifications thereof shown in FIG. 12 and FIG. 13, a mode in which the processing of small-sized sheets and large-sized sheets is changed by making the conductive loops 53, 55, 58 operative or inoperative has been exemplified. However, the present invention is not limited to such a mode. For example, to process the recording members (sheets) which differ in three or more sizes, the conductive loops 53, 55, 58 may be selectively operated corresponding to the areas where the sheets of respective sizes do not pass.

For example, following provisions or the like may be suitably selected. That is, a ladder-shaped conductive loop may be provided with the plural switches and these switches may be suitably changed over or selected so as to change an area to which the magnetic flux generated from the conductive loop is applied. Alternatively, a sufficiently large conductive loop may be made movable and the conductive loop is moved to be selectively aligned with any one of areas where the sheets do not pass corresponding to various sizes.

(Embodiment 3)

Figure 14:
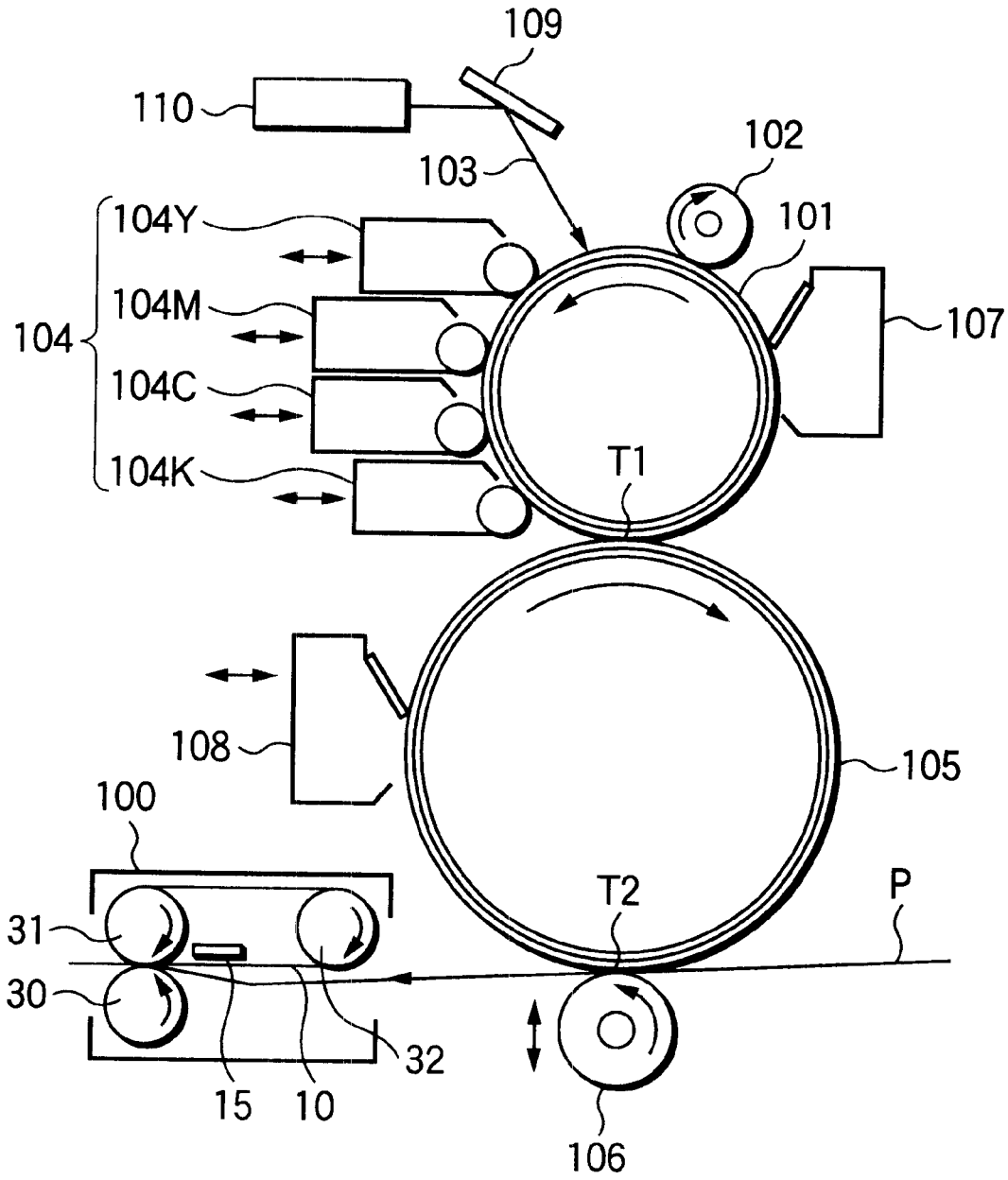
FIG. 14 is an explanatory view showing an embodiment 3 of an image recording device to which the present invention is applied.

FIG. 14 is an explanatory view showing an embodiment 3 directed to an image recording device to which the present invention is applied.

The image recording device according to this embodiment is an electrophotography color printer of an intermediate transfer type into which a heating and fixing device 100 according to the embodiment 1 or the embodiment 2 is incorporated. In this embodiment, constituent parts identical with those of the embodiment 1 and the embodiment 2 are given same numeral as the embodiment 1 and the embodiment 2 and their detailed explanation is omitted here.

In FIG. 14, numeral 101 indicates a photosensitive drum (image carrier) which is made of organic amorphous material or amorphous silicone photosensitive material and which is rotatably driven in the counter-clockwise direction indicated by an arrow at a given process speed (peripheral speed).

Around the photosensitive drum 101, image forming devices including a charging device 102 such as a charging roller, an optical unit 110 such as a laser scanner, developing devices 104 for respective color components (to be more specific, a yellow developing device 104Y, a magenta developing device 104M, a cyan developing device 104C, a black developing device 104K), an intermediate transfer drum 105, a cleaner 107 and the like are disposed.

In this embodiment, first of all, the photosensitive drum 101 receives uniform charging processing having a given polarity and potential at the charging device 102 such as the charging roller in its course of rotation.

Subsequently, the photosensitive drum 101 receives scanning exposure processing of target image information by beams 103 outputted from the optical unit 110. The optical unit 110 outputs beams 103 which are modulated (ON/OFF) in response to time-sequential electric digital pixel signals of the target image information from an image signal generating device such as an image reader not shown in the drawing and then forms a latent image corresponding to the scanned and exposed target image information on a surface of the photosensitive drum 101. In the drawing, numeral 109 indicates a mirror which deflects the output beams 103 from the optical unit 110 to an exposure position of the photosensitive drum 101.

In forming a full-color image, a first color decomposed component image of the target full color image, for example, a yellow component image is scanned and exposed so as to form a latent image and this latent image is developed as a yellow toner image using the yellow developing device 104Y of the four-color developing device 104. This yellow toner image is transferred onto a surface of the intermediate transfer drum 105 at a primary transfer portion T1 which constitutes a contact portion (or a closely approaching portion) between the photosensitive drum 101 and the intermediate transfer drum 105. The surface of the photosensitive drum 101 after transferring the toner image to the intermediate transfer drum 105 is cleaned by removing adhering residues such as a transfer residual toner or the like using cleaner 107.

Such a process cycle including charging, scanning and exposure, developing, primary transfer and cleaning is also sequentially performed with respect to respective color decomposed component images, that is, a second color decomposed component image (for example, mazenta component image, the mazenta developing device 104M being operated), a third color decomposed component image (for example, cyan component image, the cyan developing device 104C being operated) and a fourth color decomposed component image (for example, black component image, the black developing device 104K being operated) of the target full color image. Accordingly, toner images in four colors in total including an yellow toner image, a mazenta toner image, a cyan toner image and a black toner image are sequentially transferred in an overlapped manner onto the surface of the intermediate transfer drum 105 and a color toner image which corresponds to the target full-color image is formed by synthesizing them.

The intermediate transfer drum 105 includes a resilient layer of an intermediate resistance and a surface layer of a high resistance on a metal drum, for example. The intermediate transfer drum 105 is rotatably driven in the clockwise direction indicated by an arrow at a peripheral speed approximately equal to the peripheral speed of the photosensitive drum 101 under the condition that the intermediate transfer drum 105 is brought into contact with the photosensitive drum 101 or approaches closely to the photosensitive drum 101. Further, a bias potential is applied to the metal drum of the intermediate transfer drum 105 so as to transfer the toner image on the photosensitive drum 101 side to the intermediate transfer drum 105 side making use of the potential difference between the intermediate transfer drum 105 and the photosensitive drum 101.

In a secondary transfer portion T2 which constitutes a contact nip portion between the rotating intermediate transfer drum 105 and the transfer roller 106, the color toner image formed by synthesizing on the surface of the rotating intermediate transfer drum 105 is transferred to a recording member P fed into the secondary transfer portion T2 from a sheet feeding portion not shown in the drawing at a given timing. The transfer roller 106 integrally and sequentially transfers the synthesized color toner image from the intermediate transfer drum 105 surface side to the recording member P surface side by supplying an electric charge of polarity inverse to the polarity of the toner from the back surface of the recording member P. The recording member P which has passed the secondary transfer portion T2 is separated from the surface of the intermediate transfer drum 105 and is delivered to a heating and fixing device 100 where the recording member P receives the heating and fixing processing of the unfixed toner image and then the recording member P is discharged to a sheet discharge tray outside the machine not shown in the drawing as a color image formed object.

After the color toner image is transferred to the recording member P, the surface of the intermediate transfer drum 105 is cleaned by removing adhering residues such as the transfer residual toner, powdered paper or the like using the cleaner 108. This cleaner 108 is usually held in a non-contact state with the intermediate transfer drum 105 and is held in a contact state with the intermediate transfer drum 105 in the course of performing the secondary transfer of the color toner image to the recording member P from the intermediate transfer drum 105.

Further, the transfer roller 106 is also held in a non-contact state with the intermediate transfer drum 105 and is held in a contact state with the intermediate transfer drum 105 by way of the recording member P in the course of performing the secondary transfer of the color toner image to the recording member P from the intermediate transfer drum 105.

Further, the image recording apparatus of this embodiment also can perform a printing mode of a monochroic image such as a black-and-white image.

Further, the image recording apparatus of this embodiment also can perform a double-sided image printing mode or a multi-image printing mode. In performing the double-sided image printing mode, the recording member P which is delivered from the heating and fixing device 100 and on which a first-time image is already printed is again fed to the secondary transfer portion T2 by way of a re-circulating transport mechanism not shown in the drawing with both surfaces thereof turned over, receives a transferred toner image on a second surface, is again fed to the heating and fixing device 100 to receive the fixing processing of the toner image to the second surface and is outputted as a both-sided image print.

In performing the multi-image printing mode, the recording member P which is delivered from the heating and fixing device 100 and on which a first-time image is already printed is again fed to the secondary transfer portion T2 by way of a re-circulating transport mechanism not shown in the drawing with both surfaces thereof not turned over, receives a transferred second toner image on the surface on which the first-time image has been already printed, is again fed to the heating and fixing device 100 to receive the fixing processing of the second toner image and is outputted as a multi-image print.

Particularly, in this embodiment, when the heating and fixing device of the embodiment 1 is incorporated into the image recording device as the heating and fixing device 100, it becomes possible to always make the heat generation distribution over the entire area of the fixing belt 10 in the widthwise direction uniform. Further, when the heating and fixing device of the embodiment 2 is incorporated into the image recording device as the heating and fixing device 100, the image recording device can process the recording members P of different sizes and hence, the image recording device can always maintain the heat generation distribution of the fixing belt 10 uniform even when the recording member P is either of a small size or of a large size.

(Embodiment 4)

Figure 15:
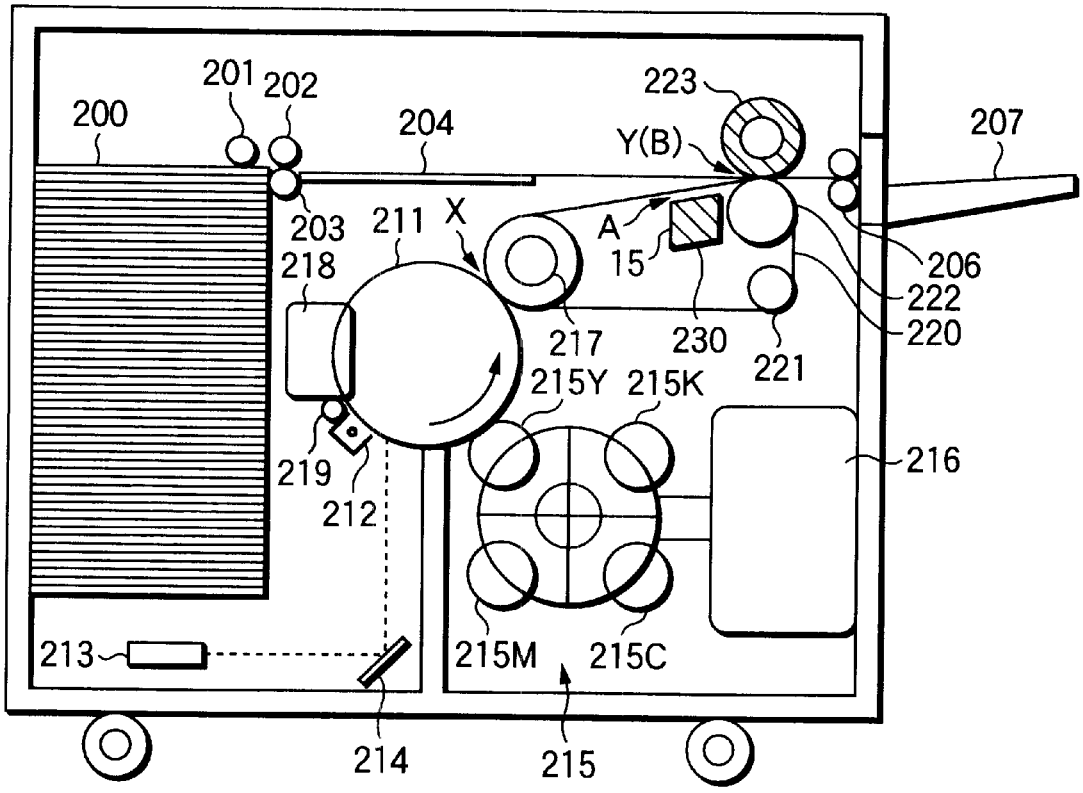
FIG. 15 is an explanatory view showing an embodiment 4 of an image recording device to which the present invention is applied.

FIG. 15 is an explanatory view showing an embodiment 4 of an image recording device to which the present invention is applied.

The image recording device according to this embodiment is of a transfer simultaneous fixing type which uses an intermediate transfer belt, wherein an electromagnetic induction heating device which uses the intermediate transfer belt as an object to be heated is incorporated into the image recording device.

As shown in the drawing, the image recording device includes a photosensitive drum 211 on which a latent image is formed on a surface thereof due to the difference of electrostatic potentials. The image recording device includes, around the photosensitive drum 211, a charging device 212 which approximately uniformly charges a surface of the photosensitive drum 211, an exposure portion which includes a laser scanner 213 which forms a latent image on the photosensitive drum 211 by irradiating laser beams corresponding to respective color signals, a mirror 214 and the like, a rotary-type developing device 215 which accommodates respective toners of four colors made of cyan, mazenta, yellow and black and visualizes the latent image on the photosensitive drum 211 by using respective color toners, an endless intermediate transfer belt 220 which is supported such that the transfer belt 220 can be circulated in a fixed direction, a primary transfer roller 217 which is arranged such that the primary transfer roller 217 faces the photosensitive drum 211 in an opposed manner while sandwiching the intermediate transfer belt 220 therebetween and transfers the toner image to the intermediate transfer belt 220, a cleaning device 218 which cleans the surface of the photosensitive drum 211 after the transferring, and a static eliminating lamp 219 which eliminates static electricity from the surface of the photosensitive drum 211.

Further, in the inside of the image recording device, there are provided a tension roller 221 which is arranged in place to stretch the intermediate transfer belt 220 together with the primary transfer roller 217, a drive roller 222, a pressure roller 223 which is arranged such that the pressure roller 223 faces the drive roller 222 in an opposed manner while sandwiching the intermediate transfer belt 220 therebetween, a sheet feed roller 201 and a resist roller 203 which transport recording members P accommodated in a sheet feeding unit 200 one by one, a recording member guide 204 which supplies the recording member P between the intermediate transfer belt 220 wound around the drive roller 222 and the pressure roller 223.

Further, at the upstream of a position in the circulating direction of the intermediate transfer belt 220 which faces the pressure roller 223 in an opposed manner, an electromagnetic induction heating device 230 which heats the toner image from the back surface side of the intermediate transfer belt 220 is provided.

In FIG. 15, numeral 206 indicates a discharge roller which discharges the recording member on which the image has been fixed and numeral 207 indicates a discharge tray which accommodates the discharged recording member.

The photosensitive drum 211 is provided with a photosensitive layer made of OPC or a-Si on a surface of a cylindrical conductive substrate and the conductive substrate is electrically grounded.

The rotary-type developing device 215 is provided with four developing units 215C, 215M, 215Y, 215K which respectively accommodate toners of cyan, mazenta, yellow and black. Respective developing units 215–215K are rotatably supported such that they can face the photosensitive drum 211 in an opposed manner. In respective developing units 215C–215K, developing rollers which form toner layers on surfaces thereof and deliver toner to positions which face the photosensitive drums 211 in an opposed manner are provided. A given voltage which superposes a given direct current to a given alternating current is applied to these developing rollers and the toners are transferred onto the latent image on the photosensitive drum 211 due to an action of the electric field. Further, respective toners are replenished into respective developing units 215C, 215M, 215Y, 215K from a toner hopper 216.

Further, the intermediate transfer belt 220 includes three layers, that is, a base layer (a belt substrate) made of resin or rubber having high heat resistance, a conductive layer (an electromagnetic induction heat generating layer) laminated on the base layer and a surface peel-off layer which constitutes an uppermost layer.

On the other hand, the electromagnetic induction heating device 230 processes the intermediate transfer belt 220 as an object to be heated and arranges the magnetic field generating device 15 of the embodiment 1 or the embodiment 2 at the back surface side of the intermediate transfer belt 220.

Subsequently, the manner of operation of the image recording device of this embodiment is explained hereinafter.

The photosensitive drum 211 is rotated in the direction indicated by an arrow in the drawing. After being approximately uniformly charged by the charging device 212, laser beams which are subjected to the pulse width modulation in accordance with yellow image signals from an original are irradiated from a laser scanner 213 to the photosensitive drum 211 so that an electrostatic latent image corresponding to the yellow image is formed on the photosensitive drum 211. This electrostatic latent image for the yellow image is developed by a yellow developing unit 215Y which is preliminarily fixedly positioned at a developing position by the rotary-type developing device 215 so that a yellow toner image is formed on the photosensitive drum 211.

In a primary transfer portion X where the photosensitive drum 211 and the intermediate transfer belt 220 are brought into contact with each other, the yellow toner image is electrostatically transferred onto the intermediate transfer belt 220 due to an action of the primary transfer roller 217. This intermediate transfer belt 220 performs the circulating movement in synchronism with the photosensitive drum 211 so that the intermediate transfer belt 220 continues the circulating movement while holding the yellow toner image on the surface thereof and waits for the transfer of a mazenta image which comes next.

On the other hand, after the surface of the photosensitive drum 211 is cleaned by a cleaning device 218, the photosensitive drum 211 is approximately uniformly charged again by the charging device 212 and then laser beams are irradiated from the laser scanner 213 onto the photosensitive drum 211 in accordance with the image signals of the next mazenta.

During the course in which an electrostatic latent image for mazenta is formed on the photosensitive drum 211, the rotary-type developing device 215 is rotated and fixes the developing unit 215Y for mazenta at the developing position to perform developing using the mazenta toner. A mazenta toner image formed in this manner is electrostatically transferred onto the intermediate transfer belt 220 at the primary transfer portion X.

Subsequently, the above-mentioned processing are respectively performed with respect to cyan and black and when the transfer of four colors onto the intermediate transfer belt 220 is finished or in the midst of the transfer toner of black which is the last color, a recording member (a sheet) accommodated in a sheet feeding unit 200 is fed by an operation of a sheet feed roller 201 and is transported to a secondary transfer portion Y by way of a resist roller 202 and a recording member guide 204.

On the other hand, the toner image made of four colors transferred onto the intermediate transfer belt 220 passes a heating area A which faces the electromagnetic induction heating device 230 in an opposed manner at the upstream of the secondary transfer portion Y. In the heating area A, the magnetic flux generated from the magnetic field generating device 15 is applied to a conductive layer (a heat generating layer) of the intermediate transfer belt 220 so that the conductive layer of the intermediate transfer belt 220 generates heat due to the electromagnetic induction heating. Accordingly, the conductive layer is rapidly heated and this heat is transmitted to the surface layer as time lapses and the toner on the intermediate transfer belt 220 becomes the fused state when the toner image reaches the secondary transfer portion Y.

Particularly, in this embodiment, when the magnetic field generating device 15 of the embodiment 1 is incorporated into the image recording device, it becomes possible, for example, to always make the heat generation distribution over the entire area of the intermediate transfer belt 220 in the widthwise direction uniform. Further, when the magnetic field generating device 15 of the embodiment 2 is incorporated into the image recording device, the image recording device can process the recording members P of different sizes and can suppress the flux applied to a portion of the intermediate transfer belt 220 which corresponds to the area where the recording member P does not pass. Accordingly, even when the recording member P is of a small size or of a large size, there is no possibility that the temperature of the portion of the intermediate transfer belt 220 which corresponds to the area where the recording member P does not pass is partially elevated after the recording member passes so that the heat generation distribution of the intermediate transfer belt 220 after passing of the recording member P can be always maintained uniform.

Further, the toner image fused on the intermediate transfer belt 220 is brought into close contact with the recording member due to the pressure of the pressure roller 223 along with the transporting of the recording member at the secondary transfer portion Y. In the heating area A, the intermediate transfer belt 220 is locally heated only in the vicinity of the surface thereof so that the fused toner which is brought into contact with the recording member of a room temperature is rapidly cooled. That is, at a point of time that the fused toner passes the nip of the secondary transfer portion Y, due to the heat energy held by the toner and the pressure force, the toner instantly impregnates into the recording member so that the transfer and the fixing of the toner image are performed. The recording member is transported to an exit of the nip while taking way the heat of the intermediate transfer body which is heated only in the vicinity of the surface so that the toner image is approximately perfectly transferred and fixed onto the recording member.

Thereafter, the recording member onto which the toner image is transferred and fixed is discharged onto a discharge tray 207 through a discharge roller 206 thereby the full color image forming is completed.

When the intermediate transfer belt 220 passes the heating area A, the conductive layer (the heat generating layer) of the intermediate transfer belt 220 is no more heated and hence, the temperature of the conductive layer is lowered since the heat is taken away by the surrounding base layer and the surface peel-off layer. The temperature of the toner is continuously elevated until the toner image reaches the secondary transfer portion Y (transfer and fixing area B) since the toner receives the transmission of heat from the surface peel-off layer even after the intermediate transfer layer passes the heating area A.

At an entrance of the transfer and fixing area B, the toner and the intermediate transfer belt 220 are brought into contact with the recording member of a room temperature. When the temperature of the toner at a moment that the toner is brought into contact with the recording member is lower than a softening point of the toner, since the adhesive force acting on an interface between the toner and the recording member is not sufficient, it gives rise to a fixing failure. Accordingly, it is necessary to control a heating quantity by the electromagnetic induction heating device 230 such that the temperature of the toner at a moment that the toner is brought into contact with the recording member becomes not less than the softening temperature of the toner.

In this manner, according to the image recording device of the present invention, in the heating area A where the intermediate transfer belt 220 faces the electromagnetic induction heating device 230 in an opposed manner, the portion in the vicinity of the conductive layer (heat generating layer) of the intermediate transfer belt 220 which absorbs the electromagnetic wave is heated, while in the transfer and fixing area B, the toner fused by heating in the heating area A is brought into pressure contact with the recording member of a room temperature so that the toner image is fixed simultaneously with the transferring. Since the intermediate transfer belt 220 has only a thin outermost surface thereof heated, the room temperature of the intermediate transfer belt 220 is lowered immediately after transferring and fixing. Accordingly, the storage of heat in the inside of the device can be reduced.

As has been described heretofore, according to the electromagnetic induction heating device of the present invention, a magnetic flux adjusting member which is interlinked with a portion of the magnetic flux generated from the exciting coil which constitutes the magnetic field generating unit is provided, and the magnetic flux which is applied from the exciting coil to the electromagnetic induction heat generating layer of the object to be heated is locally adjusted. Accordingly, the magnetic flux distribution ranging from the exciting coil to the electromagnetic induction heat generating layer of the object to be heated can be locally adjusted so that, a desired heat generation distribution which matches the purpose can be easily obtained as the heat generation distribution of the object to be heated. For example, the magnetic flux. distribution applied to the electromagnetic induction heat generating layer can be made uniform so that the distribution of heat generation from the electromagnetic induction heat generating layer can be made uniform whereby the object to be heated can be uniformly heated.

Further, according to the present invention, by further providing the adjustment varying unit to the magnetic flux adjusting member so as to adjust the degree of magnetic flux adjustment performed by the magnetic flux adjusting member, even under the condition that the plural target heat generation distributions are necessary, the optimal heat generation distributions corresponding to various conditions can be easily obtained with a single magnetic field generating unit.

Still further, according to an image recording device which uses an electromagnetic induction heating device according to the present invention, as the heat generation distribution necessary at the time of recording the image to the recording member, a desired heat generation distribution which matches the object can be easily obtained so that the image output of high quality can be easily obtained.

The entire disclosure of Japanese Patent Application No. 2000-295017 fled on Sep. 27, 2000 including specification, claims, drawings and abstract is incorporated herein by reference in its entirety.

We claim:

1. An electromagnetic induction heating device comprising:

an object to be heated having at least an electromagnetic induction heat generating layer;

a magnetic field generating unit which is arranged facing the electromagnetic induction heat generating layer of the object to be heated and includes an exciting coil which generates a magnetic flux penetrating the electromagnetic induction generating layer; and a magnetic flux adjusting member which is made to be interlinked with a portion of the magnetic flux of the exciting coil to generate an electromagnetic induction action such that the magnetic flux acting on the electromagnetic induction heat generating layer is changed, the magnetic flux adjusting member being arranged in a non-overlapping position with the exciting coil.

2. The electromagnetic induction heating device according to claim 1, wherein the magnetic flux adjusting member is a conductive loop formed by winding a conductive wire once or a plurality of times.

3. The electromagnetic induction heating device according to claim 2, wherein the magnetic flux adjusting member is a conductive loop formed by winding the conductive wire which is constituted by a bundle of wires formed by bundling conductive lines.

4. The electromagnetic induction heating device according to claim 1, wherein the magnetic flux adjusting member is a conductive member made of material having low permeability.

5. The electromagnetic induction heating device according to claim 1, wherein the magnetic flux adjusting member is held by a holder in which the exciting coil is held.

6. The electromagnetic induction heating device according to claim 1, wherein the magnetic flux adjusting member is disposed in the vicinity of an inner periphery or an outer periphery of the exciting coil.

7. The electromagnetic induction heating device according to claim 1, wherein the magnetic flux adjusting member is disposed at a side opposite to the exciting coil while sandwiching the object to be heated between the magnetic flux adjusting member and the exciting coil.

8. The electromagnetic induction heating device according to claim 1, wherein the magnetic flux adjusting member is disposed at a side opposite to the object to be heated while sandwiching the exciting coil between the magnetic flux adjusting member and the object to be heated.

9. The electromagnetic induction heating device according to claim 1, wherein the magnetic flux adjusting member is disposed such that a magnetic flux portion which corresponds to a position where the magnetic flux is larger than the periphery thereof among the magnetic flux applied to the electromagnetic induction heat generating layer is interlinked with the magnetic flux adjusting member.

10. The electromagnetic induction heating device according to claim 1, further comprising an adjustment varying unit which is capable of varying the degree of magnetic flux adjustment performed by the magnetic flux adjusting member.

11. The electromagnetic induction heating device according to claim 10, wherein the adjustment varying unit is a switching element which opens or closes the conductive loop which constitutes the magnetic flux adjusting member.

12. The electromagnetic induction heating device according to claim 10, wherein the adjustment varying unit movably supports the magnetic flux adjusting member so as to change the interlinking area of the magnetic flux adjusting member to a portion of the magnetic flux of the exciting coil.

13. An image recording device comprising:

an electromagnetic induction heating device comprising a magnetic field generating unit which is arranged facing an electromagnetic induction heat generating layer of an object to be heated and includes an exciting coil which generates a magnetic flux penetrating the electromagnetic induction heat generating layer; and a magnetic flux adjusting member which is made to be interlinked with a portion of the magnetic flux of the exciting coil to generate an electromagnetic induction action such that the magnetic flux acting on the electromagnetic induction heat generating layer is changed, the magnetic flux adjusting member being disposed in a non-overlapping position with the exciting coil.

14. The image recording device according to claim 13, further comprising an image forming unit which forms an unfixed image, the electromagnetic induction heating device being used as a heating and fixing device which fixes by heating the unfixed image formed by the image forming unit on a recording member.

15. The image recording device according to claim 13, further comprising:

an image carrier transport body which has the electromagnetic induction heat generating layer and which is used as the object to be heated on which an unfixed image is carried and transported;

an image forming unit which forms an unfixed image on the image carrying transport body; and a fixing device which his disposed at a downstream position of a portion facing the exciting coil of the image carrying transport body and performs transferring and fixing by at least pressing the object to be fixed which is fused on the image carrying transport body to the recording member.

16. The image recording device according to claim 13, wherein the magnetic flux adjusting member is disposed at a position corresponding to an area other than an area where the recording member passes.

17. The image recording device according to claim 13, wherein the electromagnetic induction heating device is further provided with an adjustment varying unit which is capable of varying the degree of magnetic flux adjustment performed by the magnetic flux adjusting member, the degree of magnetic flux adjustment being varied by the adjustment varying unit corresponding to the recording members which differ in dimensions, and a magnetic flux adjusting action by the magnetic flux adjusting member is applied to a portion corresponding to an area other than an area where the recording member passes.

18. The image recording device according to claim 13, wherein the magnetic flux adjusting member is positioned on a same plane with the exciting coil.

19. An electromagnetic induction heating device comprising:

an object to be heated having at least an electromagnetic induction heat generating layer;

a magnetic field generating unit which is arranged facing the electromagnetic induction heat generating layer of the object to be heated and includes an exciting coil which generates a magnetic flux penetrating the electromagnetic induction generating layer; and a magnetic flux adjusting member which is made to be interlinked with a portion of the magnetic flux of the exciting coil to generate an electromagnetic induction action such that the magnetic flux acting on the electromagnetic induction heat generating layer is changed, the magnetic flux adjusting member positioned on a same plane with the exciting coil.

20. The electromagnetic induction heating device according to claim 19, wherein the magnetic flux adjusting member is a conductive loop formed by winding a conductive wire once or a plurality of times.

* * * * *